US006978096B2

(12) United States Patent
Maeshima

(10) Patent No.: US 6,978,096 B2
(45) Date of Patent: Dec. 20, 2005

(54) IMAGE PROCESSING APPARATUS

(75) Inventor: Toshiyuki Maeshima, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 102 days.

(21) Appl. No.: 10/784,940

(22) Filed: Feb. 25, 2004

(65) Prior Publication Data

US 2004/0170443 A1 Sep. 2, 2004

(30) Foreign Application Priority Data

Feb. 28, 2003 (JP) ..... 2003-052509

(51) Int. Cl.[7] ..... G03G 15/00
(52) U.S. Cl. ..... 399/82; 399/83; 399/85; 399/86
(58) Field of Search ..... 399/81, 82, 83, 399/85, 86

(56) References Cited

U.S. PATENT DOCUMENTS 4,627,710 A * 12/1986 Goetz ..... 399/82
6,581,097 B1 * 6/2003 Lynch et al. ..... 709/226
6,738,587 B1 * 5/2004 Hoene et al. ..... 399/77

* cited by examiner

*Primary Examiner*—Hoang Ngo
(74) *Attorney, Agent, or Firm*—Finnegan, Henderson, Farabow, Garrett & Dunner, L.L.P.

(57) ABSTRACT

An image processing apparatus for executing a job by using a job parameter set including a combination of values of various setup items which define an operation condition of the job as a work unit, the image processing apparatus provided with: a job parameter memory for memorizing a plurality of job parameter sets, each of the plurality of job parameter sets being associated with a page size of an input image of a job having been executed; a page size acquiring device for acquiring a present page size of an input image of a present job to be executed; and a job parameter election device for electing a candidate for a job parameter set for the present job by retrieving the present page size among the plurality of job parameter sets memorized in the parameter memory.

34 Claims, 10 Drawing Sheets

FIG. 2

100

| | USER ACCOUNT | FUNCTION MODE | PAGE SIZE | COUNT | JOB PARAMETER | | | | |
|---|---|---|---|---|---|---|---|---|---|
| | | | | | ONE-SIDE/DUPLEX | COPY DENSITY | MAGNIFICATION | PAPER | ORIGINAL IMAGE QUALITY |
| 101 | taroh | | A | | ONE-SIDE→ONE-SIDE | 5 | 1 | A | CHARACTER |
| | taroh | Fax | A | | ONE-SIDE | 3 | 1 | A | CHARACTER |
| | jiroh | Scanner | A | | ONE-SIDE | 5 | 1.2 | A | PHOTOGRAPH |
| | jiroh | Printer | A | | ONE-SIDE→ONE-SIDE | 5 | 1.5 | A | CHARACTER/PHOTOGRAPH |
| | saburoh | Scanner | A | | ONE-SIDE | 5 | 2 | A | PHOTOGRAPH |
| | taroh | Scanner | B | | ONE-SIDE | 5 | 0.8 | A | CHARACTER |
| 102 | taroh | | A4R | 243 | ONE-SIDE→ONE-SIDE | 3 | 1 | A4R | CHARACTER |
| 103 | taroh | | A4R | 223 | DUPLEX→DUPLEX | 3 | 1 | A4R | PHOTOGRAPH |
| | taroh | Fax | A | 244 | ONE-SIDE | 4 | 1 | A | PHOTOGRAPH |
| | jiroh | | A | 165 | ONE-SIDE→DUPLEX | 5 | 0.8 | A | CHARACTER/PHOTOGRAPH |
| | jiroh | | A4R | | ONE-SIDE→ONE-SIDE | 5 | 1.5 | A4R | PHOTOGRAPH |
| | saburoh | Fax | A | 5 | ONE-SIDE | 5 | 2 | A | PHOTOGRAPH |
| | saburoh | | A | 300 | ONE-SIDE→ONE-SIDE | 6 | 1 | A | PHOTOGRAPH |

FIG. 3

49

| SIMILAR SIZE / DETECTED SIZE | A4 | A4R | B5 | B5R | A5 | A5R | B6 | 8.5×11 | 8.5×11R |
|---|---|---|---|---|---|---|---|---|---|
| A4 | | ○ | × | × | × | × | × | ○ | ○ |
| A4R | ○ | | × | × | × | × | × | ○ | ○ |
| B5 | × | × | | ○ | × | × | × | × | × |
| B5R | × | × | ○ | | × | × | × | × | × |
| A5 | × | × | × | × | | ○ | × | × | × |
| A5R | × | × | × | × | ○ | | × | × | × |
| B6 | × | × | × | × | × | × | | × | × |
| 8.5×11 | ○ | ○ | × | × | × | × | × | | ○ |
| 8.5×11R | ○ | ○ | × | × | × | × | × | ○ | |

IMAGE PROCESSING APPARATUS

BACKGROUND OF THE INVENTION

The present invention relates to an image processing apparatus, particularly to an image processing apparatus performing the functions of a copying machine, printer, scanner and facsimile machine.

A multifunctional machine integrating the functions of a copying machine, printer, scanner and facsimile machine contains various setup items for defining the job operation conditions such as resolution, density and enlargement/reduction rate. A user can execute a job under a desired operation conditions by appropriate change of the value of the setup item, when inputting a job such as copying.

Normally, the standard value for each setup item is registered in advance as a machine default value. When a job is inputted, this machine default value is presented as a default value of each setup item. If the set value displayed by default is satisfactory, the operation of the start key alone is satisfactory. If there is any setup item for changing a condition, it is sufficient to change the set value only for that item.

If such a machine default value is closer to the actual status of use operation, there will be greater saving of the trouble in changing the set value separately when the job is inputted. For this reason, an apparatus for automatic setup change of has been proposed. This apparatus counts the frequency of use for each value of a setup item, and ensures that the set value for the highest frequency of use will be the machine default value of each setup item. (See Patent Document 1).

Another proposed apparatus is the one that controls the frequency of use according to time zone. For example, in a printer compatible with multiple printer languages, the frequency of use of the program corresponding to each language is counted for each time zone, and the program of the highest frequency of use in each time zone is activated in advance in that time zone and is made to wait. (Patent Document 2).

[Patent Document 1]

Japanese Application Patent Laid-Open Publication No. 2000-168173

[Patent Document 2]

Japanese Application Patent Laid-Open Publication No. Hei 11-312061

In cases where the set value displayed by default when the job is inputted is restricted to the machine set value alone, there are a great variety of methods of use by a user even if the machine default value is optimized based on the frequency of use, and there is a big deviation in the frequency of use for each set value in some cases. In such cases, it is difficult to provide an accurate default display of the set value desired by the user, and a separate change of the set value becomes essential in many cases.

Even when arrangements are made in such a way the frequency of use is obtained for each time zone and the set value to be displayed by default is switched according to the time zone, the setting desired by the user cannot be displayed by default at a high probability if there is no sufficient deviation in the frequency of use in each time zone. This increases the need of changing the set value, and it has been difficult to ensure satisfactory operability.

This invention has been made to solve such problems of the conventional technology. It is intended to provide an image processing apparatus that ensures simple setting of various setup items for defining job operation conditions so as to meet the user's requirements.

SUMMARY OF THE INVENTION

The major points of the present invention for achieving the aforementioned objects are summarized in the following items of invention:

(1) An image processing apparatus comprising:

a job parameter memory 41 capable of memorizing multiple job parameter sets associated with the page size of the input image in a job executed using this job parameter set, wherein the aforementioned job parameter set consists of a combination of the values of various setup items for defining the operation conditions of the job as a work unit;

page size acquiring devices 22 and 31 for acquiring the page size of the input image related to the job to be inputted this time; and a job parameter election device 46 for checking the job parameter memory 41 to elect the candidates for the job parameter set used in the job to be inputted this time, using the aforementioned page size acquired by the page size acquiring devices 22 and 31.

According to the aforementioned invention, the candidates for job parameter sets are elected based on the input image page size. Since the input of an image as an object for image processing is essential for image processing, various setup items can be set with a small amount of operation in conformity to the user's requirements, by electing a job parameter set based on the page size as information that can be acquired from such an essential operation.

Election of a desired setting is achieved merely by setting the original for a user executing a job repeatedly based on almost the same setting for each page size, for example, 30 copies of B4-sized original or one copy of A3-sized original in a reduced form. This arrangement provides simple operation and improved convenience. The setup items included in the job parameter set are those that can be selected when the user inputs a job. For example, there is no need of including the setup items that are automatically selected according to any standard or by necessity.

The input image can be obtained from an original mounted on an original platen glass or electronic data such as printing data to be received from a computer or the like. The information on page size is obtained by a sensor attached to the original platen glass when the input image is obtained from an original. When the input image is received in the form of electronic data as in the case of a print job, page size is obtained from the information contained in the header.

Election based on the page size includes election based on the page size of the input image agreeing with that associated with the job parameter set or based on the similar page size. Further, in order to elect a job parameter set, it is possible to add other elements such as a job type, for example, a copy job or facsimile transmission job, user account, used time zone, frequency of use, and number of input images (one or more than one).

(2) This image processing apparatus is characterized in that the aforementioned page size acquiring devices 22 and 31 contains an original size detector 22 for detecting the size of the original set on an original platen glass, and the size of the aforementioned original is acquired as a page size of the aforementioned input image.

According to the aforementioned invention, the size of the original set on the original platen glass by a user is acquired as the page size of the input image related to the job of this time. To be more specific, the job parameter set is elected based on the information obtained from the operation, essential to job input, of setting the original.

(3) This image processing apparatus further comprises an execution history registration device 43 for registering the execution history of the job executed for each job parameter set using it, wherein the aforementioned job parameter election device 46 elect the aforementioned candidates based on the page size acquired by the page size acquiring devices 22 and 31 and the job execution history registered in the execution history registration device 43.

According to the aforementioned invention, the candidates of the job parameter set are elected based on both the page size and execution history. This allows a desired job parameter set to be elected according to the state of use in the past. The execution history includes the number of job executions, date of execution and their combination. For example, the job parameter set that has been used frequently in the recent week can be selected on a selective basis. In this manner, the execution number of times within a certain period can be incorporated in the candidate election standard.

(4) This image processing apparatus is characterized in that the aforementioned execution history registration device 43 counts the number of execution, and the result of counting is registered as the aforementioned execution history.

The aforementioned invention allows the number of job executions to be registered as execution history, with the result that the candidates for job parameter sets are elected based on the page size and execution number of times. For example, the job parameter sets of a higher frequency of use elected according to the page size are used on a priority basis. Election of candidates based on both the page size and execution number of times makes it possible to elect the job parameter set meeting the user's requirements with greater probability. This arrangement ensures the job parameter set to be elected in conformity with the daily mode of use, without being affected by a temporarily used setting.

(5) This image processing apparatus is characterized in that the execution history registration device 43 registers the job execution date as the aforementioned execution history.

According to the aforementioned invention, the job execution date is registered as execution history. Accordingly, candidates for the job parameter set are elected based on the page size and execution date. For example, from the job parameter sets elected according to the page size, previously executed ones are elected on a priority basis. This enables the recent form of use to be reproduced on a priority basis to execute the job. This arrangement also enhances convenience for the user who employs the date as a reference—for the user who wishes to take a copy using the same setting as that of yesterday for example.

(6) This image processing apparatus further comprises job parameter displays 13 and 61 that present to the user the candidates for the job parameter sets elected by the job parameter election device 46, and answer receiving devices 12 and 71 that ask the user whether the candidates presented by the job parameter displays 13 and 61 should be adopted or not. This image processing apparatus is characterized in that the aforementioned job parameter election device 46 narrows the list of candidates for the job parameter set to one candidate and elects it and the aforementioned job parameter displays 13 and 61 presents to the user the details of the set value contained in the aforementioned elected job parameter set.

According to the aforementioned invention, the candidate list is narrowed to one candidate, which is presented to the user. This arrangement permits the details of the job parameter set as a candidate to be displayed on the screen with its area restricted. It also allows the details of the candidate job parameter set to be checked without performing a separate operation. The user can make a quick and easy decision on whether this job parameter set is adopted or not.

(7) This image processing apparatus further comprises tabulated list displays 13 and 62 for showing a tabulated list the job parameter set candidate elected by the job parameter election device 46, and selection receiving devices 12 and 72 for receiving selection, by the user, of the job parameter set employed by the job to be inputted this time, out of the candidates shown by the aforementioned tabulated list displays 13 and 62.

According to the aforementioned invention, elected candidates for job parameter sets are displayed in the form of a tabulated list, thereby receiving selection by the user from the list. Compared with the cases where candidates are displayed one by one and a decision is made on whether the candidate is adopted or not, this arrangement permits quick selection of a desired candidate from many. If more than one candidate has been selected, they can be in a tabulated list. Alternatively, one candidate is displayed at first. If this is rejected, other candidates can be shown in a tabulated list.

(8) This image processing apparatus further comprises a sorting device 64 that re-sorts the candidates elected by the aforementioned job parameter election device 46, according to a certain standard. This image processing apparatus is characterized in that the aforementioned tabulated list displays 13 and 62 show a tabulated list if the candidates for the job parameter set according to the order having been rearranged by the sorting device 64.

According to the aforementioned invention, a tabulated list is given in the order rearranged according to a certain standard. This method makes it easy to find out a job parameter set meeting the user's requirements from the list. The re-sorting standard includes the job parameter set name, job parameter set registration date, execution date, execution number of times, and the execution number of times within the specified time period, as well as the ascending and descending orders of these items. Especially when re-sorting is based on the execution history such as the execution number of times and date of execution, the tabulated list is displayed in the order in conformity to the status of past uses. This ensures easier finding of a setting meeting the user's requirements.

(9) This image processing apparatus is characterized by the capability of changing the standard for re-sorting by the aforementioned sorting device 64.

According to the aforementioned invention, the candidates displayed on a tabulated list can be re-sorted in conformity to various types of standards. This permits quick and easy finding of a desired job parameter set by selecting the standard that ensures easier search by the user. Convenience will be further improved by making arrangements in such a way that the re-sorting standard in the display of a tabulated list can be registered for each user or each job type (function mode), and automatic change of the standard can be made for each user or each job type.

(10) This image processing apparatus is characterized in that the aforementioned tabulated list displays 13 and 62 display any one of the following items for each job parameter set; a job parameter set name assigned to job parameter set, the total execution number of times of the job executed by using the job parameter set, and the date of previous execution of the job executed by using the job parameter set.

The aforementioned invention provides the user with the effective material for decision-making when selecting the job parameter set from the ones displayed in a tabulated list. Namely, when a tabulated list is given in the restricted display area, it is difficult to display all the details of the job parameter set. Rather than viewing the details themselves, it is more convenient in many cases to use the identification information giving straightforward representation of the features and attributes of the job parameter set. Accordingly, information effective for selection is given to the user in a smaller display area by showing a tabulated list of the identification information such as the job parameter set name. The job parameter set name can be configured in such a way as to permit separate designation of the name that can be made more easily by a user. Alternatively, the apparatus can be so configured as to enable automatic generation and assignment of a job parameter set name.

(11) This image processing apparatus is characterized in that the aforementioned job parameter set is administered for each user, and the job parameter election device 46 elects the aforementioned candidate from the job parameter sets associated with the user wishing to input the job.

The aforementioned invention administers the job parameter set for each user. Precise election of candidates for the job parameter set meeting the user's requirements is ensured even when use of an apparatus is shared by multiple users. To put it more specifically, administration for each user as used herein includes the steps of user authentication is carried out in the use of an apparatus, storing of the job parameter set in the job parameter memory 41 for each user (for each user account) from the job parameter set corresponding to the authorized user, and election of candidates based on the page size or the like.

(12) This image processing apparatus is characterized in that authentication of the user wishing to input a job is carried out by any one of a key card, key counter, coin vendor, password input device, ID number input device, fingerprint authentication and voice recognition.

The aforementioned invention permits user authentication by various means. Of these means, the key card, key counter and coin vendor allow the user to be authenticated in conformity to the user operation of inserting a key card and loading a coin. Thus, user authentication can be ensured without the need of a separate operation for authentication or reduction in convenience. It is also possible to make such arrangements that user authentication is made by a combined use of a user name and password together with the key counter.

(13) This image processing apparatus is characterized in that the aforementioned job is classified into many types of function modes based on the function, the job parameter set is administered for each of the aforementioned function modes, and the aforementioned job parameter election device 46 selects the aforementioned candidate from the job parameter sets corresponding to the function mode of the job to be inputted this time.

The aforementioned invention allows the job parameter set to be administered for each of the job function modes. The function mode refers to the mode for job types such as copy job, scan job, print job, facsimile transmission job, and facsimile reception job. The set values of various setup items are closed related to the job function mode. If the function mode is different, the set value is different in many cases even if the page size is the same. Precise election of a job parameter set meeting the user's requirements is ensured by administering the job parameter set for each function mode in the multi-functional image processing apparatus.

To put it more specifically, administration for each function mode in the sense in which it is used here refers to the cases where the user specifies the function mode in the use of the apparatus, the job parameter set is stored in the job parameter memory 41 for each function mode, and the candidates are elected based on the page size and the like from the job parameter sets corresponding to the specified function mode. If the job parameter set is administered for each user and each function mode, further precise election of the candidates meeting the user's requirements can be provided.

(14) This image processing apparatus further comprises a machine default memory 42 for storing the machine default value of the job parameter set and normal setting image screen displays 13 and 63 for displaying the normal setting screen to change the set value for each setup item. It is further characterized in that the job parameter set used by the job inputted this time is adopted from the candidates selected by the job parameter election device 46, whereby the normal setting image screen displays 13 and 63 show the normal setting screen with the aforementioned machine default value used as the default value of each setup item, if rejected by the user.

The aforementioned invention displays the normal setting screen with the machine default value used as the default value if the proposed candidate has been rejected by the user. This arrangement defines the setting status as a reference prior to change and facilitates partial change in favor of the preferred setting.

(15) The image processing apparatus further comprises a parameter determination device 48 for determining whether or not the job can be executed according to the job parameter set used by the job inputted this time, and an alarm device 81 that, when the parameter determination device 48 has determined impossible execution, notifies the user of this decision, and prompts the user to change the set value that has caused impossible execution.

According to the aforementioned invention, when the selected job parameter set contains a set value that cannot be set in the current machine status, the user is notified to that effect, and is prompted to solve the problem. This arrangement prevents job entry from being suddenly rejected when impossible execution has been determined, or the job from being executed by change of the set value without approval of the user. This arrangement also prompts partial correction, and this eliminates the need of setting from the beginning, thereby allowing job execution to be performed under the operation conditions close to the user's requirements by the minimum change operation. It should be noted that impossible execution includes the case where the result of processing cannot be outputted to the output destination specified by the job parameter set. For example, it includes the case where there is no specified folder available in the job of transferring the read image data to a computer, or where a computer is not connected.

(16) This image processing apparatus is characterized in that, when the impossible execution is due to the lack of recording paper of the specified size, the aforementioned alarm device 81 gives notice to that effect, thereby prompting the user to change the size of recording paper or to supply paper.

According to the aforementioned invention, if there is a lack of the recording paper of the size specified by the job parameter set, notice is given to that effect, to prompt change of the size of recording paper or to supply paper. If paper can be supplied, the job can be executed under the operation condition meeting the user's requirements. Thus, this method is counted as one of the alternatives to be presented to the user.

(17) This image processing apparatus further comprises:

a parameter determination device 48 for determining whether or not the job can be executed according to the job parameter set used in the job inputted this time;

an outputting site changing device 52 that, when this parameter determination device 48 has determined that the job cannot be executed and this impossible execution is due to the failure of outputting to the specified ejection tray, checks whether or not there is any ejection tray capable of correct outputting, and changes the output destination to that tray if there is any; and a change notification device 82 that, when the output destination has been changed by the outputting site changing device 52, notifies the user thereof.

According to this invention, when the ejection tray specified by the job parameter set cannot be used due to stack-over or the like, there is an automatic change of the tray to the one that can be used, and the user is notified of the result. Automatic change is performed without giving a serious effect to the user. This arrangement saves the time and trouble of the user and improves the convenience.

(18) This image processing apparatus further comprises a page size likeness table 49 that associates a similar page size for each page size and registers it, and is characterized in that, if the job parameter memory 41 does not contain the job parameter set corresponding to the page size acquired by the page size acquiring devices 22 and 31, the job parameter election device 46 acquires the page size similar to the aforementioned page size from the page size likeness table 49, and the candidates for the job parameter set are elected based on this similar page size.

According to the aforementioned invention, if the job parameter set corresponding to the page size of the input image is not yet stored in the job parameter memory 41, the job parameter set is elected based on the similar page size. The candidates for the setting closer to meeting the user's requirements can be elected by using the similar page size as an alternative. Thus, even when candidates elected on the basis of the similar page size do not meet the user's requirements, the amount of required correction is reduced. It is also possible to arrange the page size likeness table 49 so that the fixed value is registered as the one that cannot be rewritten, or the user can change the setting of the initial registration as desired.

(19) This image processing apparatus further comprises a parameter determination device 48 for determining whether or not the job can be executed according to the job parameter set used for the job to be inputted this time, and an alternative value estimation device 51 having the steps of:

electing the job parameter set according to which the job can be executed, when the parameter determination device 48 has determined that execution is impossible, wherein this job parameter set has the same set value other than that of the setup item having caused impossible execution as that of the job parameter set having been determined as inexecutable;

picking up the set value of the same setup item as that having caused impossible execution from this job parameter set; and presenting it to the user as an alternative.

According to the aforementioned invention, the alliterative value for the setup item having caused impossible execution is obtained from same job parameter sets having the same set value as that other than the setup item having caused impossible execution. Since an alternative is acquired from the job parameter set having the similar operation conditions as described above, it is possible to assume the alternative meeting the user's requirements.

(20) This image processing apparatus is characterized in that the job parameter set used in the job to be inputted this time is additionally stored into the job parameter memory 41 if it is a new one.

According to the aforementioned invention, a new job parameter set is automatically registered, thereby saving the time and effort for registration and enhancing convenience. When the job parameter set is registered, automatic generation of a job parameter set name is recommended. In this case, it is preferred to generate automatically the name that assists estimation of the contents of the job parameter set. For example, it is preferred to generate automatically the job parameter set name consisting of a combination of the name or abbreviation of the setup item different from the machine default value in the set value contained in the job parameter set. If the screen size permits, more information can be included in the job parameter set name. Further, to present the contents of the setting in a limited space, a symbol or pattern may be used, for example. It is also possible to make such arrangements that the user is prompted to determine the need of automatic registration, to evaluate the adequacy of the automatically generated job parameter set name or to correct such a name, when the job is inputted.

(21) This image processing apparatus further comprises a job parameter delete device 53 for deleting the job parameter set stored in the job parameter memory 41.

According to the aforementioned invention, when the automatically registered job parameter set contains the set which is unwanted or has come into disuse recently, such a set is deleted from the job parameter memory 41. It can be deleted by the user operation or can be automatically deleted under a certain condition, for example, of long-time disuse. In this case, it is preferred to make arrangements that the user be asked whether deletion is necessary or not. For example, a user is asked about the need of automatic deletion of the job parameter set related to that user when the user has inputted the job. This will provide accurate information on the decision of the relevant user.

(22) This image processing apparatus further comprises a job parameter correction device 53 for editing and correcting the job parameter set stored in the job parameter memory 41.

According to the aforementioned invention, the registered job parameter set can be edited and corrected. For example, editing and correction are enabled by getting into the Edit/Correct mode from the menu.

(23) This image processing apparatus is characterized in that the job parameter delete device 53 has the function of correcting the contents of the job parameter set elected by the aforementioned job parameter election device 46 based on the user instruction.

According to the aforementioned invention, the job parameter set elected as a candidate can be corrected. This arrangement allows the correction of part of the job parameter set presented as a candidate, and ensures easy configuration of the setting meeting the user's requirements. It is effective especially where there is no registration of a job parameter set completely meeting the user's requirements, or when correction or modification of part of the job parameter set presented as a candidate is easier than searching of a set completely meeting the user's requirements.

(24) This image processing apparatus further comprises a job parameter copy device 53 for creating a copy of the job parameter set stored in the aforementioned job parameter memory 41.

The aforementioned invention allows a copy of the job parameter set to be created. This arrangement provides easy creation of a job parameter set partly different from the already registered one, based on the copy.

(25) This image processing apparatus allows the aforementioned copy to create as any one of the machine default value, the job parameter set of another user and the job parameter set of the same user.

The aforementioned invention allows full use of the copying function. All the convenient job parameter sets can be made open to the user if copying is possible as a machine default value. When copying of the job parameter set can be provided to other users, a new user can receive a convenient job parameter set provided by the current user, for example, with the result that time and effort will be saved.

(26) This image processing apparatus is characterized in that, when the job parameter copy device 53 creates a copy as a job parameter set of the same user, the job parameter set name different from the original job parameter set name is assigned thereto.

This invention eliminates duplications of the effort in creating the job parameter sets of the same name. For example, the name of a new job parameter set can be automatically created by copying, by adding special letters or consecutive numbers to the end of the name of the item from which copying is made. This arrangement not only ensures easy generation but also allows the original job parameter set to be estimated from the name of the new name.

(27) This image processing apparatus further comprises a destination confirmation device 83 for checking with a user to determine whether or not the destination denoted by destination information is adopted or not, wherein this destination information for specifying the output destination is registered in a form associated with the job parameter set used in the job to be inputted this time.

This invention makes it possible to check with a user to determine whether or not the destination information registered in a form associated with the job parameter set is adopted or not. This arrangement eliminates the possibility of incorrect outputting to a destination not intended by the user. The destination includes a fax destination, e-mail address, the destinations of a folder and directory when the image read by a scanner is stored in a server as a file, and an ejection tray. The destination information is incorporated in the job parameter set as one setup item.

(28) This image processing apparatus is characterized in that, when the setup item of the job to be inputted this time incorporates the destination information for specifying an output destination, the default value of the setup item related to this destination information is set in such a way that destination is not yet specified.

In this invention, the state of unspecified destination is default-displayed. This requires the user to specify the destination. Further, there is no need of registering by associating the job parameter set with destination information. When the destination is left unspecified, an error occurs in the step of checking for destination, with the result that the user is prompted to enter the destination.

(29) This image processing apparatus is characterized in that, when the operation has been made to confirm the job parameter set used in the job to be inputted this time, the job input operation is started without waiting for a separate operation of specifying the start of job input.

This invention reduces the number of operations before starting the job input and enhances the convenience. To be more specific, basically, job input/execute key is further operated after confirmation of the job parameter set. By contrast, the information required for starting the job input becomes complete upon confirmation of the job parameter set and it can be estimated that sufficient confirmation has been made of the user's intention. This makes it possible to omit the operation of the execute key and to start the job input.

(30) This image processing apparatus is characterized in that job input operation is started using the aforementioned selected job parameter set, when the job input start specifying operation has been made prior to confirmation operation subsequent to selection of the job parameter set used in the job to be inputted this time.

This invention reduces the number of operations before starting the job input and enhances the convenience. To be more specific, basically, the job parameter set is confirmed upon confirmation operation subsequent to selection of the job parameter set. However, the operation of specifying the start of job input such as pressing of the execute key is estimated to also represent the intention of confirming the selected job parameter set, and hence a separate operation for confirmation is omitted.

(31) This image processing apparatus is characterized in that one or more of a copy job of optically reading an original and forming the corresponding image on a recording paper, a scan job of optically reading an original and outputting the corresponding image, a facsimile transmission and reception job and a print job of forming an image on recording paper according to the print data to be inputted are configured in an executable form.

The aforementioned invention provides an image processing apparatus having the functions of any of a copier, scanner, facsimile machine and printer. This arrangement enhances convenience and operability since the user has a great number of setup items.

BRIEF DESCRIPTION OF THE DRAWINGS

FIG. 2 is an explanatory diagram representing an example of the job parameter set stored in the job parameter memory of an image processing apparatus as one embodiment of the present invention;

FIG. 3 is an explanatory diagram representing an example of the page size likeness table of an image processing apparatus as one embodiment of the present invention;

DETAILED DESCRIPTION OF THE PREFERRED EMBODIMENT

The following describes an embodiment of the present invention with reference to drawings:

Each drawing represents an embodiment of the present invention.

The image processing apparatus as an embodiment of the present invention is configures as what is called the multi-functional machine integrating the functions of a copying machine, a printer, a facsimile machine and a scanner. It has such function modes as a copy mode, printer mode, facsimile transmission mode, facsimile reception mode and scanner mode. This image processing apparatus is designed to perform image processing in units of a page. The unit of page is a concept representing the range of an image incorporated in a continuous plane. To put it more specifically, it is preferably based on the range of an image incorporated in an A4- or B4-sized form.

The copy mode can be defined as a function mode of performing a copying job where the original placed on an original platen glass is optically read and the reproduced image is formed on a recording paper, whereby the output is printed. The printer mode refers to the function mode of performing a printing job where an image is formed on recording paper in conformity to the data received from the printing data creating apparatus of a computer or the like, whereby the output is printed. The facsimile transmission mode is a function mode of performing the facsimile transmission job where the image data obtained by optical reading of the original placed on the original platen glass or the image data received from the computer or the like, after having been compressed and encoded, are sent to a specified destination via a communications line.

The facsimile receiving mode is the function mode of executing the facsimile reception job consisting of the steps of receiving data from a remote party via the communications line, decoding it, reproducing the original image, forming this image on recording paper and printing the output or sending it to the computer.

The scanner mode is a function mode of performing the scanning job where the image data obtained by optical reading of the original placed on the original platen glass is sent to the computer.

These function modes are executed for each job as a work unit. Assume that the following job instruction is give in the copy mode; "Create 20 copies in duplex printing and bind each copy with a stapler". In this case, this work series is handled as one job. This arrangement allows the user to give work instruction to this image processing apparatus in units of job.

Various setup items are available for detailed specification of the operation conditions in the execution of a job. For example, in the copy mode, there are such setup items as copy density, scaling factor, recording paper size, one-side/duplex printing and one-side/both sides of the original. A set value desired by the user can be selected for each of these setup items.

Figure 1:
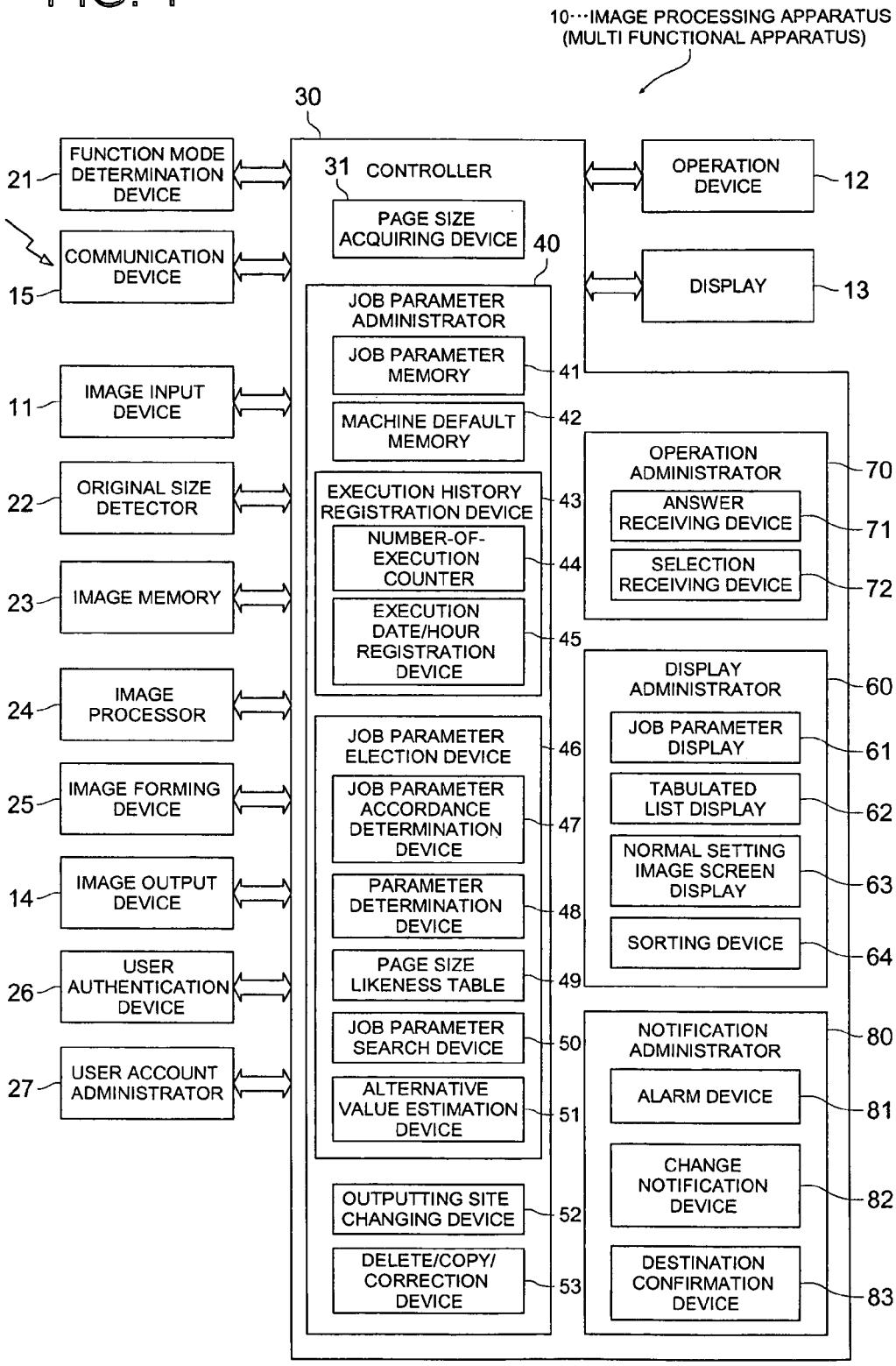
FIG. 1 is a block diagram representing the approximate configuration of an image processing apparatus as one embodiment of the present invention.

FIG. 1 is a block diagram representing the approximate configuration of an image processing apparatus 10 as one embodiment of the present invention. The image processing apparatus 10 comprises an image input device 11 for inputting the image as an object to be processed, an operation device 12 for receiving various operations from the user, a display 13 for showing the apparatus operation status and information on various operations, an image output device 14 for forming an image on recording paper and printing the output, a communication device 15 and a controller 30 for administrative control of the operations of the image processing apparatus 10.

The image input device 11 performs the function of outputting the image data by optical reading of the original placed on the original platen glass. The image input device 11 reads the original placed on the original platen glass one by one. Further, it is provided with an automatic original feeder and is designed to ensure continuous reading of multiple originals and reading of both sides of the original. In the image processing apparatus 10, the image data received by a facsimile machine and the print data received from the computer are also handled as one input image.

The operation device 12 consists of various switches and a microcomputer for detecting their operations. The display 13 consists of a display such as a liquid crystal display and control circuit for controlling such a display.

The image output device 14 performs the function of fixing and outputting the image that has been formed on recording paper with an electrophotographic process using a laser beam. The communication device 15 provides a communications function of facsimile transmission and reception, and transmission and reception of various types of data with the computer. The major components of the controller 30 include a CPU (Central Processor Unit) (not illustrated), ROM (Read On Memory) and RAM (Random Access Memory). The ROM stores the program representing the procedure for processing executed by the CPU, in addition to various types of fixed data. The RAM performs the function of storing the data temporarily required for the execution of CPU processing. Part of the RAM constitutes a nonvolatile RAM that ensures the stored data is retained even after power has been turned off.

The controller 30 is further connected with various means. Of these connected means, a function mode determination device 21 determines the type of the job required by the user. For example, when the original is placed on the original platen glass, the mode is determined as a copy mode by default. If the specified switch has been operated with the original placed on the original platen glass, the mode is determined as a facsimile transmission mode or scanner mode.

The original size detector 22 is used to detect the size of the original placed on the original platen glass. The original size is detected as a standardized size such as A4, A5, B5, B4 or legal form. When the original is placed with its orientation changed by 90 degrees, its size is detected as a different size even if the original is of the same size. For example, when the A4-sized original is placed with its orientation changed by 90 degrees, it is detected as an A4R-sized form.

An image memory 23 stores the input image and the image data during or after processing. The image processor 24 increases or reduces the size of the original, or rotates the original. The image forming device 25 restores the encoded or compressed image data into the original form, and outputs the image data of a bit map type. It also performs on-off control of the laser diode of the image output device 14.

The user authentication device 26 identifies and authenticates the user employing the image processing apparatus 10. The user account administrator 27 registers and administers the information required for user authentication. To put it more specifically, the user account administrator 27 stores the user ID and password. The user authentication device 26 serves as a password input device to prompt the user to enter the user ID and password when use of the image processing apparatus 10 has started. User authentication is performed by checking the inputted user ID and password against the information stored in the user account administrator 27.

Further, as the user authentication device 26, it is possible to use a key card, key counter, coin vendor, ID number input device, fingerprint authentication and voice recognition. Each of the key card, key counter and coin vendor is assigned with a user account. When they are used, authentication procedure is completed by insertion of the key card and key counter or insertion of a coin into the coin vendor. It is also possible to make such arrangements that the unauthenticated users are assumed as a general user for which one account is opened. The coin vendor can be administered as an independent account, or as an account for the general user.

The controller 30 performs the functions of a page size acquiring device 31, job parameter administrator 40, operation administrator 70, display administrator 60 and notification administrator 80. The page size acquiring device 31 acquires the page size of the input image of the job to be inputted this time. To put it more specifically, the input image page size is acquired based on the detection information from the original size detector 22, header portion of the print data or information acquired upon facsimile reception. The original size is represented as a standardized size such as A4, B4 or legal form. It is also possible to arrange such a configuration that the sizes (width and length) of other than the standardized one can be specified by numerical figures. When the width or length is irregular or infinite, it is handled as one type of page size. It should be noted that job input is defined as an act of giving a job execution instruction to the image processing apparatus 10, which has completed reception of this instruction. The job can be the one that is executed immediately or the one reserved for subsequent execution.

The job parameter administrator 40 performs the function of administering the set value for various setup items provided to specify the job operation conditions. The variable internally assigned to each setup item is called the job parameter. A combination of the set values for setup items, i.e. a combination of values assigned to job parameters, is called the job parameter set. These setup items can be changed by the user as desired. They need not include those parameters that are determined necessarily according to the conditions of apparatus operation or based on some standards. For example, in the case of a facsimile machine the scaling factor is automatically set according to the original size on the transmission side and the recording paper size on the reception side. The scaling factor in such a case is not included in the setup item as an object of the present invention.

The job parameter administrator 40 is subdivided into several means. Of these, the job parameter memory 41 stores multiple job parameter sets. The job parameter memory 41 stores the job parameter set by page size, user and function. The machine default memory 42 stores the machine default value for each setup item. The system is configured in such a way the machine default value adjusted just before the time of shipment can be changed by the user as desired.

The execution history registration device 43 registers the execution history of the job that has been executed using the job parameter set for each job parameter set. The execution history registration device 43 comprises a number-of-execution counter 44 that counts and registers the number of job executions performed by the job parameter set for each job parameter set, and an execution date/hour registration device 45 that registers the date and hour of job executions performed by the job parameter set for each job parameter set. It is possible to arrange such a configuration that the execution date/hour registration device 45 registers all the dates and hours of executions performed in a predetermined period of time or only the recent dates and hours of job executions.

The job parameter election device 46 ensures that the candidates for the job parameter set used in the job to be inputted this time is elected based on the page size acquired by the page size acquiring device 31 and the execution history registered in the execution history registration device 43. The job parameter election device 46 comprises the functions as a job parameter accordance determination device 47, parameter determination device 48, page size likeness table 49, job parameter search device 50 and alternative value estimation device 51.

The job parameter accordance determination device 47 searches the job parameter memory 41 using the page size, user account or function mode as a search key, and elects the matching job parameter sets. It also has a function of further narrowing these elected sets and creating a list, based on the execution history thereof. When the job parameter set used in the job to be inputted this time has been elected, the parameter determination device 48 determines whether or not the job can be executed, according to this job parameter set. It makes this decision, for example, by checking whether or not there is a shortage of paper of the size specified by the elected job parameter set or the ejection tray at the specified output destination is filled with paper to reject output.

The page size likeness table 49 registers the page size in the form associated with the page size similar to it for each page size. The job parameter election device 46 performs the function of acquiring the page size similar to that of the input image with reference to the page size likeness table 49, when the job parameter set corresponding to the page size of the input image obtained by the page size acquiring device 31 is not stored in the job parameter memory 41, and electing the candidate for the job parameter set based on this similar page size.

The job parameter search device 50 has the function of searching and electing the job parameter set according to which the job can be executed, when the parameter determination device 48 has determined that the job cannot be executed in conformity to the job parameter set selected as a candidate, wherein this job parameter set has the same set value other than that of the setup item having caused impossible execution as that of the job parameter set having been determined as inexecutable. The alternative value estimation device 51 picks up the set value of the item corresponding to the setup item having caused impossible execution in the original job parameter set, from the job parameter sets selected by the job parameter search device 50, and presents it to the user as an alternative value. It is also possible to arrange such a configuration that the alternative value estimation device 51 incorporates the functions of the job parameter search device 50.

When the parameter determination device 48 has determined that the job cannot be executed and the cause for impossible execution is the failure of outputting to the specified ejection tray, the outputting site changing device 52 checks whether or not there is any ejection tray that allows outputting, and changes the output destination to that ejection tray if there is any.

The delete/copy/correction device 53 has the function of a job parameter delete device that deletes the job parameter sets stored in the job parameter memory 41. It also has the functions of a job parameter edit/correct device that edits and corrects the job parameter sets stored in the job parameter memory 41, as well as the functions of a job parameter copy device that creates a copy of the job parameter set stored in the job parameter memory 41.

The display administrator 60 has the function of creating various screens shown on the display 13. The display administrator 60 has the functions of the job parameter display 61, tabulated list display 62, normal setting image screen display 63 and sorting device 64. The job parameter display 61 shows the candidate for the job parameter set elected by the job parameter election device 46. For example, it has a function of giving a detailed display of the contents of the candidate narrowed down to one. When there are two or more candidates for the job parameter sets elected by the job parameter election device 46, they are listed by the tabulated list display 62. The sorting device 64 has a function of rearranging the candidates of the list according to predetermined criteria, for example, by execution number of times in the descending order or by date/hour of execution in reverse chronological order. The normal setting image screen display 63 indicates the normal setting image screen for separately changing the setting of the detailed contents of the job parameter set.

The operation administrator 70 determines and analyzes the contents of the switch operation based on the information from the operation device 12. The operation administrator 70 has the function of an answer receiving device 71 for receives an answer from the user as to whether the candidate presented by the job parameter display 61 should be adopted or not, and the function of an selection receiving device 72 for receiving the selection of a job parameter set used in the job to be inputted this time out of the candidates shown in a tabulated list by the tabulated list display 62.

The notification administrator 80 presents various alarms to the user, and prompts the user to perform selective operations. It has the functions of an alarm device 81, change notification device 82 and destination confirmation device 83. Of these, the alarm device 81, if the job cannot be executed according to the job parameter set selected as the one used in the job to be inputted this time, notifies the user to that effect, thereby prompting the user to change the set value having caused impossible execution.

When the ejection tray of the output destination has been changed by the outputting site changing device 52, the change notification device 82 notifies the user to that effect. When the destination information for specifying the output destination of the result of processing is registering in the job parameter set selected as the one used in the job to be inputted this time, in the form associated therewith, the destination confirmation device 83 checks with the user to confirm whether or not he wishes to adopt the destination of this destination information. It should be noted that one form of confirmation includes the case where the default value of the setup item related to the destination information is set to the state of unspecified destination.

The destination information includes the information on facsimile transmission, e-mail address for sending e-mail by reading an image by the scanner and creating an attached file, the destinations of a folder and directory when the image read by a scanner is stored in a server as a file, and an ejection tray.

FIG. 2 shows a registration table 100 of the job parameter set stored in the job parameter memory 41. One line of the job parameter set registration table 100 forms one job parameter set 101. The job parameter set contains a user account, function mode, page size and count (the number of job executions) and various job parameters. The job parameter includes the one that specifies a one-side/duplex combination in the original and recording paper, as exemplified by decision as to whether the duplex original is put to single-sided printing or multiple single-sided originals are put to duplex printing. It also includes the ones that specify the copy density, scaling factor, recording paper size and original image quality. FIG. 2 shows an example of a job parameter set, which may includes destination information.

In FIG. 2, the execution number of times of the job with one execution history is registered in the form included in the job parameter set. The execution history can be separately administered in the form associated with the job parameter set. For example, it is possible to arrange such a configuration that an ID number is assigned to each job parameter set and the job execution history is separately registered in the execution history registration device 43 in the form associated with this ID number.

The job parameter set is registered as a different job parameter set if any one of the items other than those related to the execution history such as a count is different in its contents. For example, in the job parameter set 102 and job parameter set 103 given in FIG. 2, user account, function mode and page size are the same. Of job parameters, however, one-side/duplex item and original image quality are different, so they are registered as separate job parameter sets.

FIG. 3 shows an example of the page size likeness table 49 stored by the job parameter election device 46. In the page size likeness table 49, the page size (similar page size) similar to this page size is registered in an associated form for each page size (detected size) detected by the page size acquiring device 31. Here a matrix is created where the detected size is a row item, and the similar size is a column item. They are registered in such a way that combinations having a relationship of similarity are circled (o), and those having no relationship of similarity are marked with a cross (x).

When there are multiple similar sizes for one detected size item, it is good practice to arrange such a configuration that the degree of similarity is expressed by numerical values. For example, "A4R" has the strongest similarity to the detected size "A4", where "A4R" has the same size with "A4", but the direction is different by 90 degrees. In the degree of similarity, "A4" is followed by "8.5×11" having the same direction with a slight difference in size. This is further followed by "8.5×11R" with different direction and different size. Such a degree of similarity is registered in the descending order. When the degree of similarity is registered, the size having the greater similarity can be selected on a prior basis.

The following describes the operation of the image processing apparatus 10.

Figure 4:
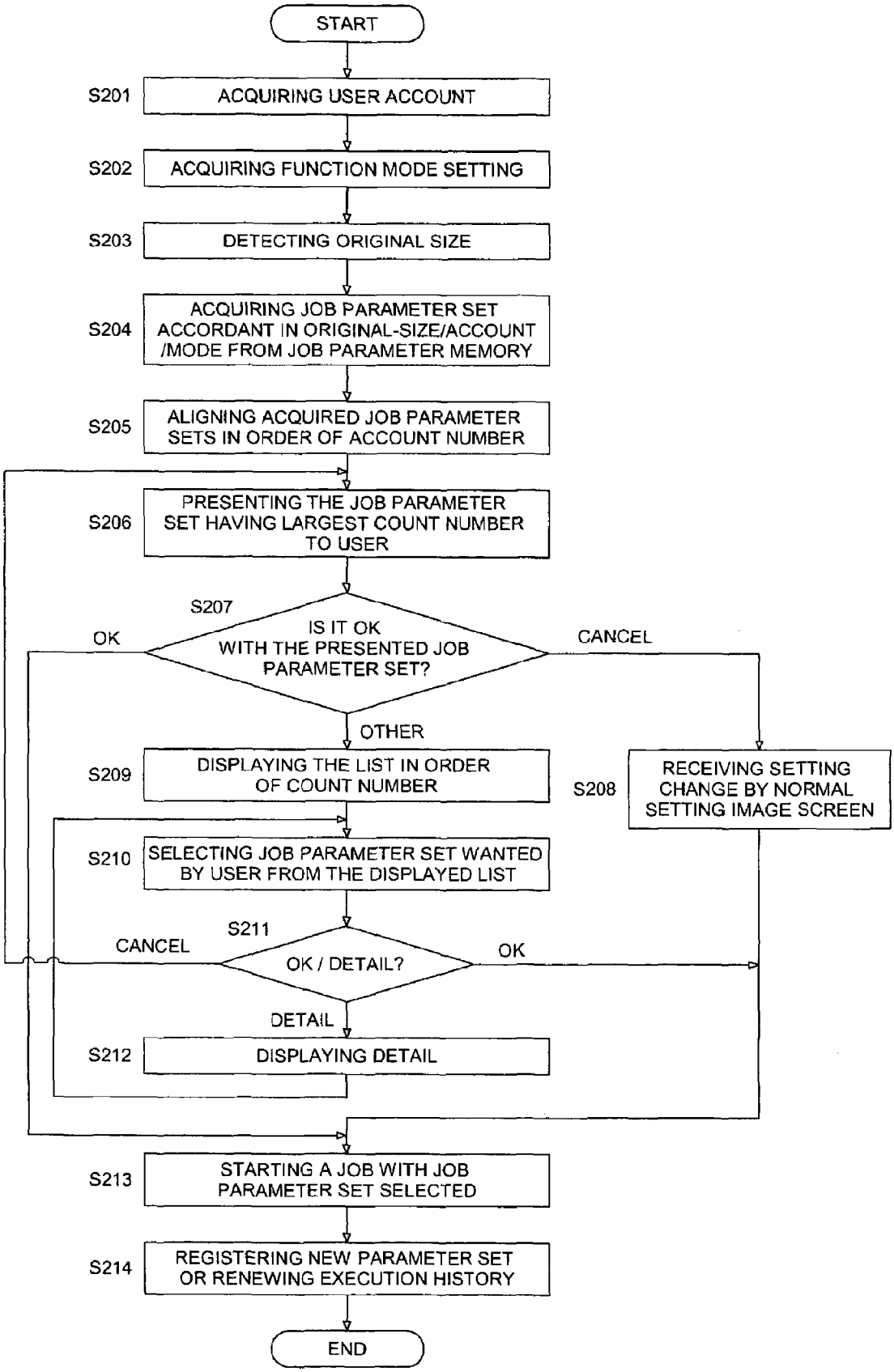
FIG. 4 is a flowchart representing the operation of inputting the job into an image processing apparatus as one embodiment of the present invention.
Figure 5:
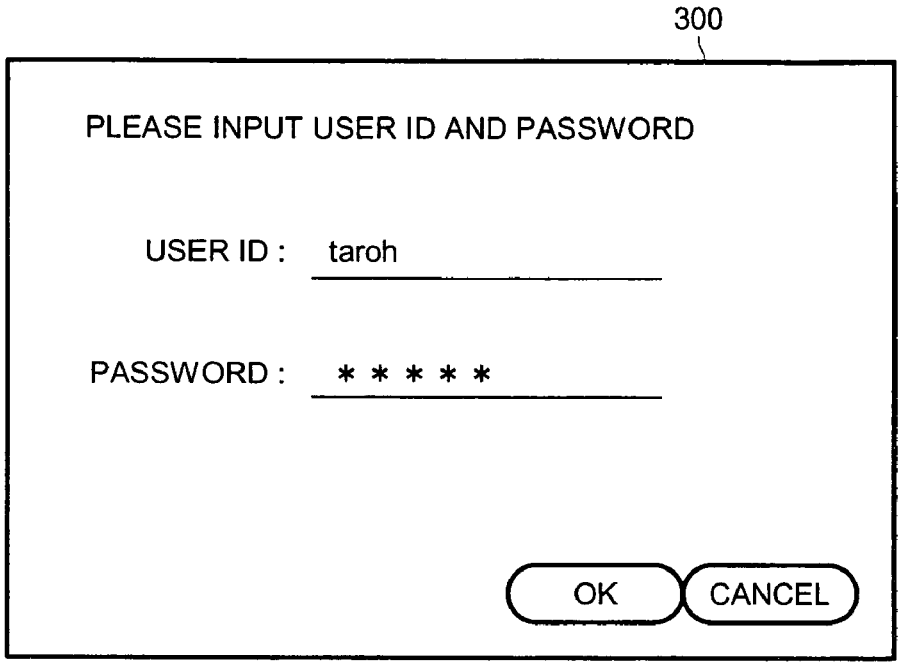
FIG. 5 is an explanatory diagram representing an example of the user authentication device of an image processing apparatus as one embodiment of the present invention.
Figure 6:
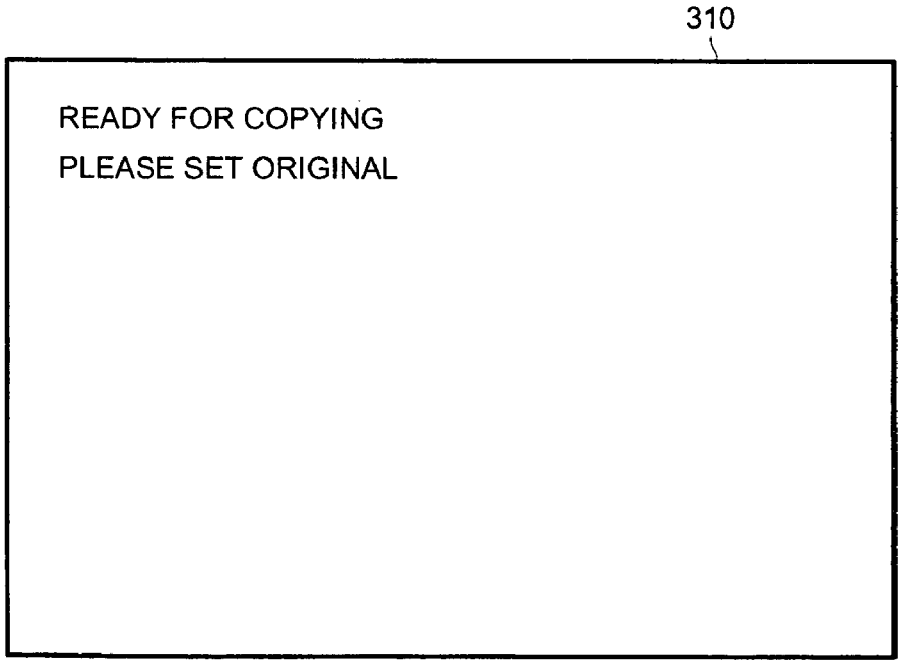
FIG. 6 is an explanatory diagram representing an example of the copy default screen displayed on an image processing apparatus as one embodiment of the present invention.

FIG. 4 is a flowchart representing the operation of inputting the job into an image processing apparatus 10. FIGS. 5 through 9 show various screens displayed by the display 13. When the image processing apparatus 10 is used, the user enters his own user ID and password to get authentication. This allows the image processing apparatus 10 to acquire the user account (Step S201). FIG. 5 shows an example of the user authentication screen 300 for inputting the user ID and password. It should be noted that the key card, key counter, coin vendor, ID number input device, fingerprint authentication and voice recognition may be used to acquire the user account. Further, configuration is arranged in such a way that, when the user cannot be identified or the user cannot be authenticated by the coin vendor, that user is used as a general user.

In the next step, the function mode specified by the user is acquired (Step S202). Here the copy mode is assumed to have been selected. In the wait status, the function mode is set to the copy mode by default. It can be switched to another function mode when the user performs a certain operation. Upon acquisition of the user account and function mode, the copy default screen 310 given in FIG. 6 appears on the display 13.

When the user has placed an original on the original platen glass, the original size detector 22 detects the original size and the page size acquiring device 31 identifies the page size of that original (Step S203). The job parameter election device 46 searches the job parameter memory 41, using this page size and together with the previously acquired user account and function as search keys. It elects the job parameter set where all these items are matched (Step S204). For example, if the current user account is "taroh", the function mode "Copy" and the page size "A4" in the state of registration given in FIG. 2, then the job parameter set 102 and job parameter set 103 will be elected.

Figure 7:
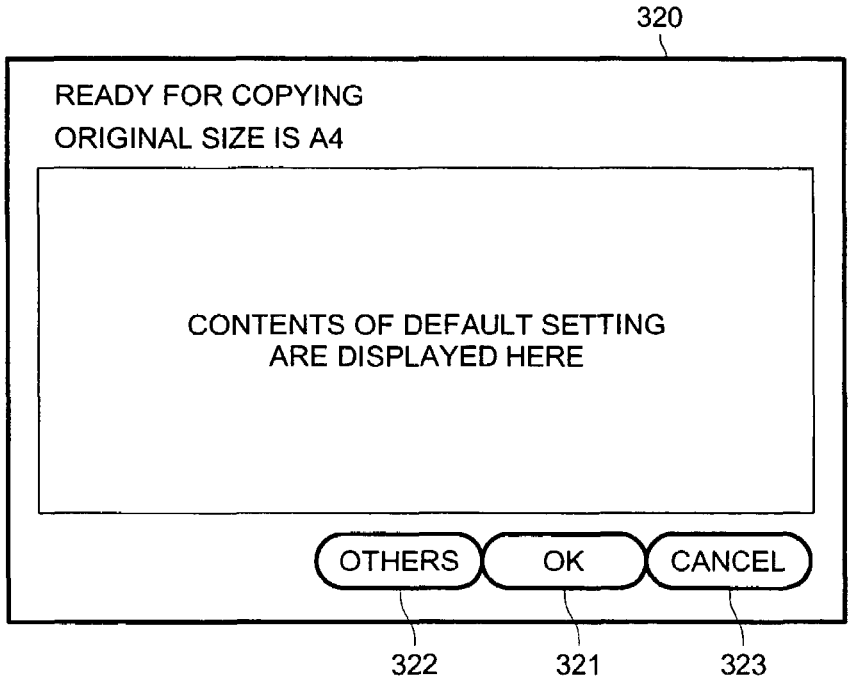
FIG. 7 is an explanatory diagram representing an example of the recommended candidate screen displayed on an image processing apparatus as one embodiment of the present invention.

The job parameter election device 46 aligns elected job parameter sets in order of the execution number of times (count) (S205) and presents the job parameter set having largest execution number of times to the user (S206). FIG. 7 shows an example of the recommended candidate screen for presenting the user with the job parameter set after its number has been narrowed down to one. The 320 recommended candidate screen 320 shows the details of the job parameter set. For example, a one-side/duplex combination, copy density, scaling factor and recording paper size are displayed in the form of a letter, symbol and pattern.

Based on the displayed contents, the user determines whether this job parameter set is adopted or not. When the user wishes to adopt the job parameter set as it is, he presses the OK button 321. When this button has been pressed (Step S207; OK), the job conditions are set according to this job parameter set and the job input operation starts (Step S213). The execution history of the job parameter set used this time is updated (S214). To put it another way, the count is incremented by "+1" or the date/hour of the previous execution is updated.

When the job parameter set used this time is a new one different from the existing ones, the new job parameter set is automatically registered. This method saves registration time and effort and enhances convenience. Whether it is new or not is determined by checking if the job parameter set where there is agreement among all set values other than those of the items related to the execution history is present in the job parameter memory 41 or not.

In the case of automatic registration of a new job parameter set, the job parameter set name is automatically generated. In this case, the generated name reflects the contents of the setting of the automatically registered job parameter set. The name giving a straightforward representation of the page size, scaling factor and original quality as exemplified by "A4-sized 100% scale photo" is automatically generated. In the automatic generation, it is also possible to arrange such a configuration that the user is prompted to determine whether or not the registered item should be adopted, or whether or not the automatically generated name should be adopted or corrected.

When a user wishes to confirm a candidate for the job parameter set different from the displayed job parameter set, he presses the OTHER button 322 on the recommended candidate screen 320. When the OTHER button 322 has been pressed (Step S207 and others), the user account, function mode and page size are used as search keys, and the candidates for the selected job parameter sets are shown in a tabulated list in the descending order of count (S209).

Figure 8:
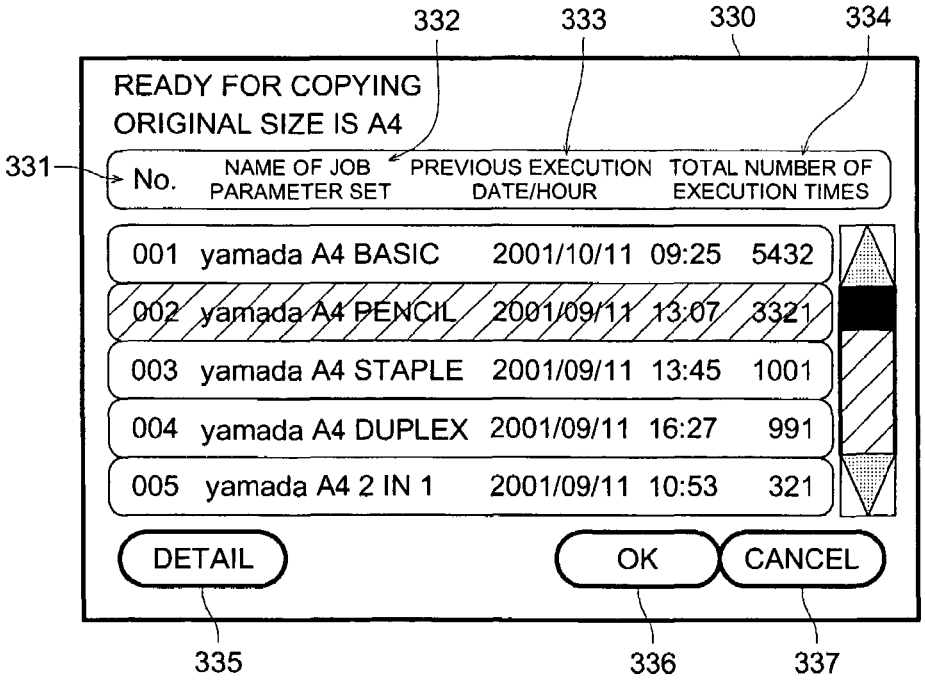
FIG. 8 is an explanatory diagram representing an example of the tabulated list screen displayed on an image processing apparatus as one embodiment of the present invention.

FIG. 8 shows an example of the tabulated list screen 330 represented the candidates for job parameter sets in a tabulated list. This list contains a No. column 331 for representing the automatically assigned ID number, a name column 332 for representing the job parameter set name, an execution date/hour column 333 for showing the date/hour of the previous execution using the job parameter set, and a execution number of times column 334 for showing the total number of job executions using the job parameter set.

The candidates having been selected on the list are shown in the form different from other candidates. Here they are shown with hatching. The user can move the selected position in the vertical direction by operating the upward pointing arrow and downward pointing arrow. When there are two many candidates for elected job parameter sets to be shown in one screen, the upward pointing arrow and downward pointing arrow are operated continuously after the selected position has shown the candidate located at the top end or bottom end of the screen, whereby the screen is scrolled and other candidates are shown one after another.

After one candidate has been selected from the list (Step S210), when the user operates the Detail button 335 of the tabulated list screen 330 (Step S211; DETAIL) the detail display screen (not illustrated) displays the detail of the selected job parameter set. When the user operates the OK button 336 of the tabulated list screen 330 (Step S211; OK) the use of the selected job parameter set is confirmed. The job operation conditions are set according to this job parameter set and jib input operation starts (Step S213). Updating of the execution history and other operations are further performed (Step S214).

If the Cancel button 337 is pressed on the tabulated list screen 330 (Step S211; Cancel), the recommended candidate screen 320 appears again. If the Cancel button 323 is again operated on the recommended candidate screen 320 (Step S207; Cancel), then the normal setting screen 340 for separate setting of each job parameter set in the normal manner will appear (Step S208).

Figure 9:
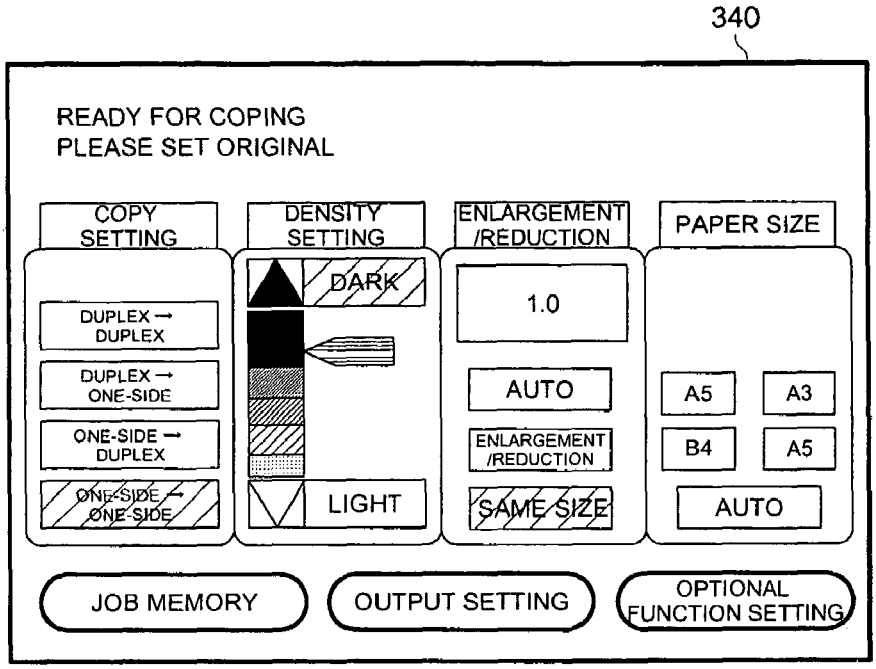
FIG. 9 is an explanatory diagram representing an example of the normal setting screen displayed on an image processing apparatus as one embodiment of the present invention.

FIG. 9 shows an example of the normal setting screen 340. The normal setting screen 340 given in FIG. 9 allows separate setting of the one-side/duplex combination, copy density, scaling actor and recording paper size. The normal setting screen 340 given in FIG. 9 uses the machine default value as a default value for each setup item. The setup status by the machine default value is displayed by default, whereby the setup status as a reference prior to modification is made clear and the user can easily make a partial modification to get his desired setting.

In the aforementioned example, the size of the original placed on the original platen glass is acquired as the page size. In the printer mode or facsimile reception mode, the page size of the input image is obtained from the information contained in the header of the print data and received data.

In the aforementioned example, the number of job execution has been used as a reference for reducing the number of candidates to one and a reference for determining the order of arrangement in the tabulated list. Other references may be used. For example, when the dates and hours of the previous executions are used in reverse chronological order, it becomes easier to reproduce the operation conditions for the previous execution and to execute the job. If the dates and hours of the previous executions are used in chronological order in the tabulated list, a desired one is easily obtainable for the user wishing to find out a job parameter set with reference to the date and hour, for example, in the case where he wants to have the job executed under the same operation conditions as those of yesterday.

Re-sorting and narrowing of the candidates can be made based on various references including a combination of the date/hour and number of job executions. For example, this method permits sorting of the items according to the execution number of times in the descending order in the recent week. Re-sorting and narrowing of the candidates are also possible with reference to the date and hour of the registered job parameter set. The reference for re-sorting and narrowing of the candidates can be set and changed as appropriate according to the user's preference. Here the condition setting screen (not illustrated) appears. Then the multiple types of re-sorting conditions prepared in advance are displayed, and the user can select any desired one from them.

The following describes the operation for determining the start of the job input operation. Basically, job input operation is started only after pressing of the Start key that directly specifies the start of job execution, subsequent to confirmation of the job parameter set. However, it can be estimated that all the information required for job execution has been prepared by the operation of confirming the job parameter set, and the user intention has been confirmed sufficiently. Job input operation is initiated by the operation of confirming the job parameter set, to put it more specifically, by the operation of the OK button 321 on the recommended candidate screen 320 or by the operation of the OK button 321 on the tabulated list screen 330. This makes it possible to omit the operation of directly specifying the job execution by pressing of the Start key, and to reduce the number of operations prior to the start of job input operation, with the result that convenience is enhanced.

When the operation of directly specifying the start of job execution has been performed, for example, the Start key has been pressed, with the job parameter set selected, job input operation is started even before the job parameter set confirmation operation is performed. The operation of the switch that directly specifies the start of job execution is assumed to represent the intention of confirming the job parameter set having been selected. This makes it possible to omit a separate operation for confirmation. For example, if the Start key (not illustrated) is pressed with the recommended candidate screen 320 being displayed or any one of the job parameter sets being selected on the tabulated list screen 330, the job parameter set is confirmed and job input operation is started using this job parameter set.

Figure 10:
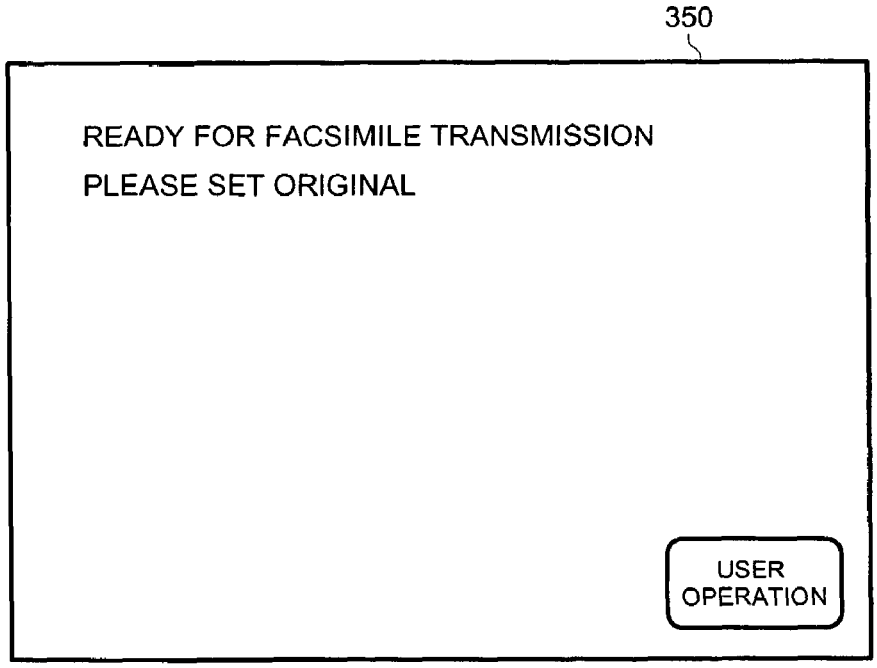
FIG. 10 is an explanatory diagram representing an example of the facsimile default screen displayed on an image processing apparatus as one embodiment of the present invention.

The following describes the case when facsimile transmission is selected as function mode. The operation flow is the same as that shown in FIG. 4. The user account is obtained on the user authentication screen 300 given in FIG. 5, then the facsimile default screen 350 given in FIG. 10 appears. When the user places an original on the original platen glass, the original size detector 22 detects the original size and the page size acquiring device 31 gets the page size of the input image based on this size. After that, using the user account, function mode and page size as search keys, candidates for the job parameter sets used in the job this time are selected from those stored in the job parameter memory 41. Further, from the selected candidates, a job parameter set having the greatest number of the executions is selected, and its details are presented to the user as a default value.

Figure 11:
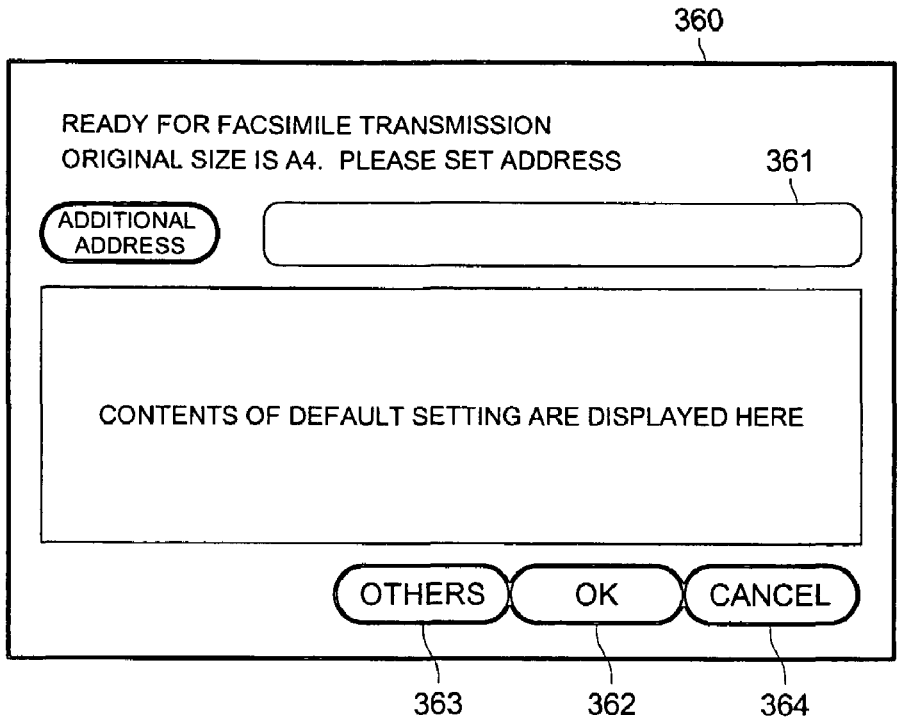
FIG. 11 is an explanatory diagram representing an example of the recommended candidate screen during facsimile transmission, displayed on an image processing apparatus as one embodiment of the present invention.

FIG. 11 shows an example of the recommended candidate screen 360 for presenting the user with the details of the job parameter set elected by reducing the number of candidates to one. The facsimile destination column 361 is shown in blank (destination unspecified). Showing the facsimile destination column 361 in blank eliminates the possibility of incorrect outputting to the destination not intended by the user. The destination includes a fax destination, e-mail address, the destinations of a folder and directory when the image read by a scanner is stored in a server as a file, and an ejection tray. They are all indicated by blank columns.

When the destination column 361 is represented by a blank column, there is no need of registering the destination information in the form associated with the job parameter set. When the job parameter set and destination information are registered in the form associated with each other, it is also possible to arrange such a configuration that the destination is default-displayed on the destination column 361 so that the user is prompted to determine adoption of the destination. If the OK button 362 is operated with the destination left in blank in the destination column 361, an error will appear since a mandatory item is not specified. Thus, the user is urged to enter the destination.

If the OK button 362 is pressed subsequent to entry of the destination, the job is inputted using the job parameter set on display, and updating of the execution history and other operations will be performed. If the OTHER button 363 is pressed, the candidates for job parameter sets will be shown in a tabulated list, similarly to the case of the tabulated list screen 330. It is also possible to make such arrangements that, if the OTHER button 363 is pressed with the destination column 361 kept in blank, this operation can be handled as an error or the entry of the address is requested again on the tabulated list screen.

Figure 12:
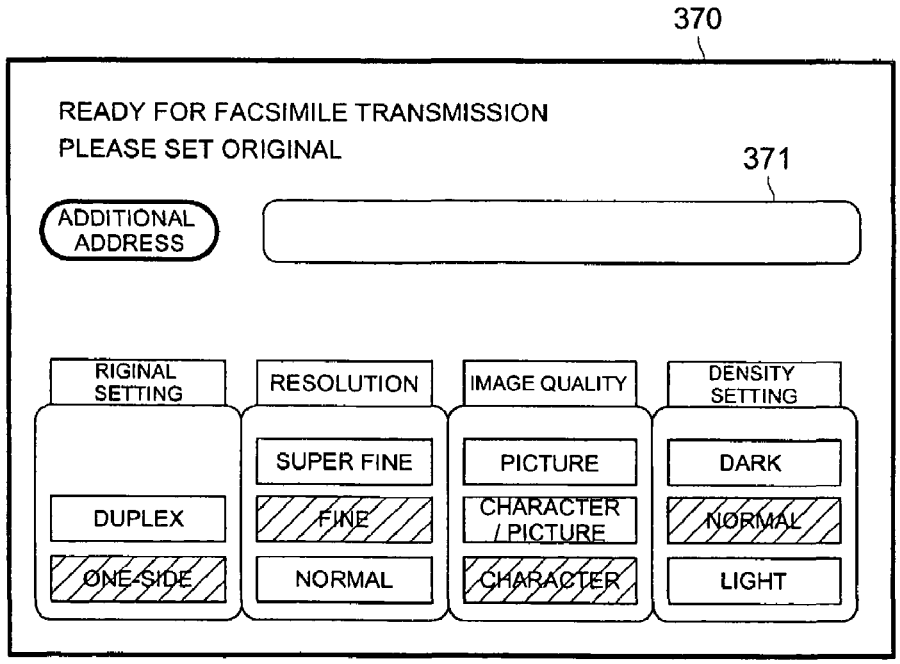
FIG. 12 is an explanatory diagram representing an example of the normal setting screen displayed on an image processing apparatus as one embodiment of the present invention.

When the Cancel button 364 is pressed on the recommended candidate screen 360, the normal setting image screen 370 given in FIG. 12 will appear. On the normal setting image screen 370 the user is allowed to separately set each job parameter set as usual. The normal setting image screen 370 given in FIG. 12 allows separate setting of the one-side/duplex combination, resolution, image quality and density. The normal setting image screen 370 uses the machine default value as the default value of each setup item. The destination column 371 is default-displayed with hatching.

Figure 13:
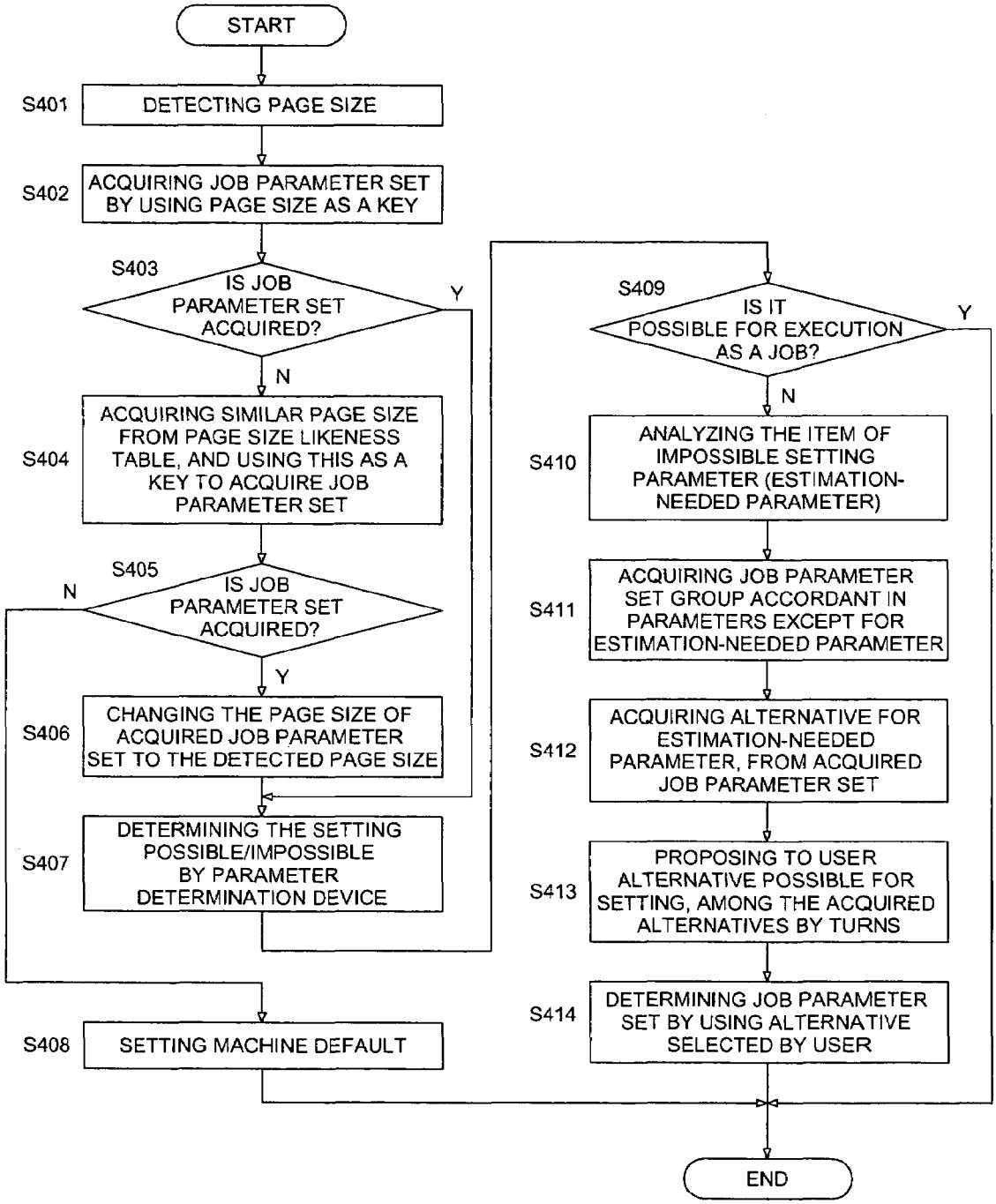
FIG. 13 is a flowchart representing the job parameter set selection procedure in an image processing apparatus as one embodiment of the present invention.

The following describes the case of job impossible execution according to the selected job parameter set:

FIG. 13 shows the process of selecting the job parameter set including the case where an error occurs. In the first place, the user account, function mode and page size are acquired (Step S401). This processing is the same as that shown in FIG. 4, and will not be described. Then the page size, user account and function mode are used as search keys to elect the candidates for job parameter sets from the job parameter memory 41 (Step S402).

When the job parameter set cannot be elected (Step S403; N), a similar page size is acquired from the page size likeness table 49 based on the previous page size. This similar page size is used to search the job parameter memory 41 to elect the candidate for the job parameter set (Step S404). The relevant job parameter set cannot be elected, for example, when the job has not yet executed under the condition where all of the previous page size, user account and function mode are matched.

When the candidate for job parameter set cannot be selected using the similar page size (Step S405; N), the default value used in the job this time is used as a machine default value (Step S408). After that, the system goes to the Step S208 given in FIG. 4 and the normal setting screen appears.

If the candidate for job parameter set can be selected using the similar page size based on the similar page size (Step S405; Y), the page size in this job parameter set is replaced by the page size acquired by the page size acquiring device 31. The result of this replacement is used as a candidate for the job parameter set (Step S406).

This is followed by the step of user's selecting the job parameter set used in the job this time, from one or multiple job parameter sets subsequent to the replacement. Alternatively, if the job parameter set can be acquired based on the page size acquired by the page size acquiring device 31 (Step S403; Y), it is followed by the step of user's selecting the selecting the job parameter set used in the job this time from these job parameter sets. This portion is the same as the processing from Step S205 through Step S213, and their description and illustration will be omitted to avoid duplication.

When the job parameter set used in the job this time has been selected, a parameter determination device 48 determines whether or not the job can be executed according to this job parameter set (Step S407). Factors causing impossible execution includes shortage of recording paper with the specified size, failure of connection to the computer specified as the file output destination, absence of the specified folder and a fully loaded ejection tray.

When execution has been determined as possible (Step S409; Y), this job parameter set is adopted (End). Then the system goes to the Step S213. When execution has been determined as impossible (Step S409; N), the setup item (parameter to be estimated) having caused impossible execution is checked (Step S410).

This is followed by the step of selecting the same job parameter sets as those where the set values other than those of the parameters requiring estimation have been determined as inexecutable (Step S411). Then the set values of the parameters requiring estimation in these job parameter sets are acquired (Step S412). Of the acquired set values, the ones that permit job execution when used as the parameters requiring estimation (values that can be set) are presented to the user one by one as alternatives of the set values having caused impossible execution, whereby the user is prompted to make a decision (Step S413).

These set values can be presented, for example, in order of the degree of similarity to the original set value or in order of the frequency of execution. For example, set values, alternative values and the degree of their similarity are predetermined and registered in the tabular form. They can be used as references to present the set values in order of the degree of similarity.

When the user has made the operation of adopting the presented alternative value, the job parameter set where the set value having caused impossible execution is replaced by this alternative value is confirmed (Step S414). After that, the system proceeds to Step S213 in FIG. 4, and job input operation starts. It should be noted that, if the alternative value desired by the user is not found among the candidates, the user can select the alternative value directly.

Figure 14:
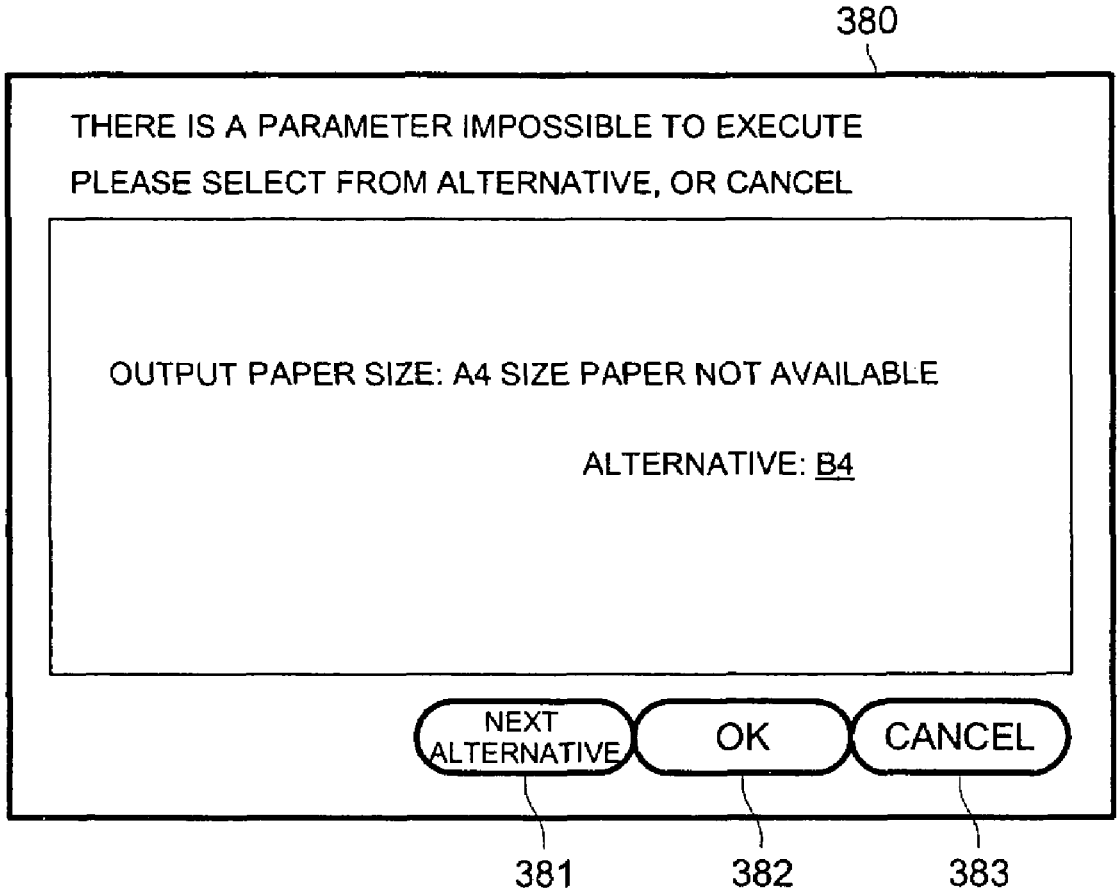
FIG. 14 is an explanatory diagram representing an example of the alternative value presentation screen displayed on an image processing apparatus as one embodiment of the present invention.

FIG. 14 shows an example of the alternative value presentation screen 380 where an alternative value in the case of impossible execution is presented to the user. This screen notifies the existence of a parameter as a cause for impossible execution and the breakdown of the impossible execution and, at the same time, presents the candidates for alternative values one by one to the user. The example of FIG. 14 notifies a shortage of A4-sized recording paper specified as having the output paper size, and presents B4-sized paper as the candidate for the alternative value, whereby the user is prompted to change the set value.

When the NEXT ALTERNATIVE button 381 of the alternative value presentation screen 380 has been pressed, the next candidate for the alternative value will appear. If the NEXT ALTERNATIVE button 381 is pressed again when the last candidate has appeared, the first candidate will appear again. If the OK button of the alternative value presentation screen 380 is pressed, the candidate on display will be determined as an alternative value. If the CANCEL button 383 is pressed, the screen for direct selection of an alternative value by the user will appear (not illustrated).

If the job parameter set selected in the aforementioned manner contains a set value that cannot be set in the current machine status, it is notified to the user as such, and the user is prompted to correct the setting. This arrangement eliminates the cases where job input is rejected immediately when execution has been evaluated as disabled, or the set value is changed without user's permission and the job is executed. Further, since this arrangement prompts the user to make a partial change, there is no need of performing all the operations again from the very beginning. This allows execution of the job under the operation conditions very close to meeting the user's requirements, with the minimum change operation.

In the event of job impossible execution according to the selected job parameter set, many solutions are available in addition to the method given above. For example, it is also possible to make such arrangements that, if impossible execution has been caused by a shortage of the recording paper having the specified size, it is notified to the user as such, and the user is prompted to change the size of recording paper or to supply recording paper. When the supply of recording paper is presented to the user as one of the alternative, the job can be executed under the operation conditions meeting the user's requirements if the paper can be supplied.

If impossible execution is caused by the failure of outputting to the specified ejection tray, the system checks if there is any ejection tray that allows outputting. If there is any, the output destination is automatically changed to that tray. Then this change of the output destination is reported to the user. Change of the ejection tray does not give a serious effect to the user, so this arrangement can be adopted. At the same time, automatic change eliminates the need of the enabled ejection tray being selected by the user, thereby enhancing convenience for the user.

The following describes the copy, edit and delete operations of the job parameter set:

The job parameter set can be deleted, edited, corrected and copied by performing a predetermined operation on the edit screen (not illustrated). If automatically registered job parameter sets contain those that are unwanted or have come into disuse, they can be deleted from the job parameter memory 41 by the delete function.

Deletion can be performed under a certain condition, in addition to the operation by the user. For example, when the job parameter set is not used beyond a predetermined time period or the frequency of execution is below the specified level within a predetermined time period, it can be deleted automatically. It is preferred to make such an arrangement that, if there is any set that should be deleted automatically, the user is asked to determine if it is to be deleted or not, and to make a decision on details at the time of job input by the user. This eliminates the possibility of deletion without the user being notified of it. Further, since the user is already identified by user authentication at the time of job input, the user can be asked at this time whether automatic deletion is performed or not. This arrangement makes it possible to confirm the user's decision.

The copy function of the job parameter set (copy creating function) allows copying to other user account, copying to the machine default value, copying from the machine default value to a specified user account and copying within the same user account. Use of the copying function may be restricted to particular users. For example, permission of copying to the other user account is granted to only the user as a source of copying, and permission of copying to the machine default value is given to only the administrator of the image processing apparatus 10.

When a job parameter set is copied, the executed history for the job parameter set on the source of copying is initialized. For example, the execution number of times is reset to "0". This is due to the reason that the executed history for each job parameter set is inherent to the job parameter set on the source of copying, and the job parameter set election standard based on the execution number of times and the like becomes ambiguous, if a hypothetical executed history is created after copying.

When the job parameter set has been copied within the same user account, the job parameter set on the destination of copying is automatically assigned with a name different from that of the job parameter set on the source. For example, if the job parameter set on the source is called "ABC", the job parameter set on the destination is assigned with "ABC2" or the like. To put it another way, a new name is formed by adding a specific character or serial number to the end of the original name. This arrangement facilitates automatic generation of the name, and ensures easy identification of the job parameter set on the source from the name of the job parameter set on the destination. The name of the job parameter set can be changed by the user as desired after copying.

In order to avoid the possibility of arbitrary change by others, job parameter set editing and deletion permission is given to only the job parameter set corresponding to the user account authenticated by the user authentication device 26. Even when the job parameter set has been edited and corrected, the execution history is not reset, unlike the case of copying. This arrangement keeps the execution history unchanged, for example, even when part of the frequently used job parameter set has been corrected for easier use. Thus, the job parameter set having been corrected is elected in the same order of priority as that of the previous one.

It is effective to arrange such a configuration that, when the job parameter election device 46 has elected the candidate for job parameter set, the contents can be edited and corrected by the user. This arrangement makes it possible to correct part of the job parameter set presented as a candidate and to get settings perfectly meeting the user's requirements. This is effective especially when a job parameter set perfectly meeting the user's requirements is not registered or when partial correction of the job parameter set presented as a candidate is easier than searching of the tabulated list to find out the set perfectly meeting the user's requirements. For example, it is a good practice to arrange such a configuration that a correction button is provided on the recommended candidate screen 320, and the set value displayed by default can be separately corrected by the user when this button has been operated.

Although the embodiments of the present invention have been described with reference to the drawings, it is clearly understood that the present invention is not restricted thereto alone. The present invention includes any modification and addition if they do not depart from the spirit of the present invention. For example, in the aforementioned embodiments, candidates for the job parameter set have been elected according to the user account, function mode and page size. It is also possible to arrange such a configuration that the candidates for job parameter sets are elected by giving further consideration to the conditions concerning the question of if the original is set on the automatic original feeder or is mounted directly on the original platen glass and if the original is monochromic or colored.

In the aforementioned embodiments, the user account and function mode are included in the search key list in addition to the page size. In an apparatus where user distinction is not made or where a single function is used, only the page size can be adopted as a search key, with the user account or function mode excluded from the search key list.

When the automatic original feeder is provided, many types of originals having different sizes may be set at the same time. In such a case, it is possible to make such arrangements that the user is asked whether the page size acquired by the page size acquiring device 31 is satisfactory or not, or that the user can set one or more than two page sizes manually. For example, if the user manually inputs the data indicating that the originals contain both A4-sized and A3-sized forms, the candidate for the job parameter set for the A-sized form and that for the job parameter set for the A3-sized form are elected respectively, and the job parameter set is elected for each original size. This arrangement will be effective in this case.

Further, in the aforementioned embodiment, a multifunctional machine integrating the functions of a copying machine, printer, facsimile machine and scanner was taken as example of an image processing apparatus for explanation. The present invention is not restricted to such a machine. It includes an apparatus having only some of these functions or the one equipped with other functions if an image is handled in units of page.

Effects of the Invention

According to the image processing apparatus of the present invention, the candidate for the job parameter set is elected, based on the input image page size as mandatory information when an image is used in units of page. This allows job operation conditions to be set to the conditions meeting the user's requirements, with the minimum change operation, with the result that operability and convenience are enhanced.

In an apparatus where the size of an original placed on the original platen glass is detected to get the page size of the input image, the input image page size can be acquired without wasting the time and effort of the user, thereby ensuring enhanced convenience. When the number of required operations is the minimum, a job can be executed under the normally preset complicated operation conditions merely by setting the original and pressing the Start key.

In an apparatus where the candidate for the job parameter set is elected based on both the page size and job execution history, the job parameter set desired by the user can be correctly elected according to the history of past uses.

In an apparatus where the number of job executions is used as an execution history, the items of a higher frequency of use are elected on a priority basis. This arrangement permits the job parameter set meeting the user's requirements to be elected with a high probability. In an apparatus where the date/hour of the job execution is used, the items used in the previous occasion can be selected on a priority basis.

In an apparatus where the number of the candidates for the job parameter set is narrowed down to one, and the details are presented to the user, details can be displayed on a limited screen. Further, since the details can be checked without a separate operation, the user can easily make a quick decision on whether this job parameter set is adopted or not, with the result that convenience is enhanced.

In an apparatus where the elected candidates for job parameter set are shown in a tabulated list for user's choice, the user can make a quick selection of his desired one from multiple candidates. In an apparatus where candidates are shown in a tabulated list in the order re-sorted according to a predetermined standard, a desired job parameter set can be easily found out by searching through the list according to this standard. In an apparatus where the standard for re-sorting can be changed, the user can easily make a quick search of his desired job parameter set if he adopts the standard that ensures easier searching. In an apparatus where any one of the job parameter set name, the total execution number of times and the date/hour of previous execution is displayed in the tabulated list, the user is provided with an effective basis for his decision on selection.

In an apparatus where the job parameter set is managed for each user, this arrangement ensures a correct choice of the job parameter set meeting the requirements of each user, even when use of the apparatus is shared by multiple users.

In an apparatus where the job parameter set is managed for each function mode of the job, this configuration ensures a correction choice of the job parameter set meeting the user's requirements, even when the apparatus is equipped with multiple function modes.

In an apparatus where the normal setting screen with the machine default value used as a default value when adoption of the proposed candidate has been rejected by the user, the status of setting as a standard prior to change is clearly defined, thereby facilitating partial change for preferred setting.

In an apparatus where, if the selected job parameter set contains the set value that causes a setting failure with the current machine status, the user is notified thereof and is prompted to make a correction, the operation conditions close to the user's requirements are formed by the minimum change operation.

In an apparatus where, in the event of a shortage of the recording paper of a specified size, the user is urged to select another size or to supply the recording paper of that size. If paper can be supplied, the job can be executed under the operation condition meeting the user's requirements.

In an apparatus where, in the event of a failure of output to the specified ejection tray, the output destination is automatically changed to the ejection tray that allows outputting, and the user is notified of the result of this change, this arrangement saves the user's time and effort for selecting the ejection tray that can be used, with the result that convenience is improved.

In an apparatus where, if there is no storage of the job parameter set corresponding to the input image page size, the candidates for job parameter set are elected based on a similar page, it is possible to elect a candidate with the settings relatively close to meeting the user's requirements.

In an apparatus where, if the job cannot be executed according to the selected job parameter set, an alternative set is acquired from the job parameter sets having the same set value as that other than the setup item having caused the impossible execution, the alternative value meeting the user's operation requirements can be estimated.

In an apparatus where, if the job parameter set used in the inputted job is new, it is automatically registered, the time and effort for registration is saved and convenience is improved.

In an apparatus where the registered job parameter set can be deleted, edited, corrected or copied, the job parameter set can be changed to meet the user's requirements. Especially in an apparatus where arrangements are made in such a way the job parameter set elected as a candidate can be corrected, part of the job parameter set displayed as a candidate can be easily corrected to obtain the settings perfectly meeting the user's requirements. In an apparatus where a job parameter set different from the original one is assigned when the job parameter set is to be copied within the same user, duplication of the name can be avoided.

In an apparatus where, if destination information is registered to specify the output destination in a form associated with the job parameter set used in the job to be inputted this time, the user is confirmed to see whether this destination is adopted or not, it is possible to eliminates the possibility of incorrect outputting to a destination not intended by the user. Especially in an apparatus where default setting is made with the destination unspecified, entry of a destination is mandatory, thereby eliminating the possibility of incorrect transmission.

In an apparatus where the job input operation is started with the operation of job parameter set confirmation, the number of required operation is reduced and convenience is further enhanced. In an apparatus where job input operation is started upon receipt of the job input start instruction prior to confirmation operation subsequent to selection of a job parameter set, there is no need for job parameter set confirmation operation. Thus, the number of required operations is reduced and convenience is enhanced.

What is claimed is:

1. An image processing apparatus for executing a job by using a job parameter set including a combination of values of various setup items which define an operation condition of the job as a work unit, the image processing apparatus comprising:

a job parameter memory for memorizing a plurality of job parameter sets, each of the plurality of job parameter sets being associated with a page size of an input image of a job which has been previously executed;

a page size acquiring device for acquiring a present page size of an input image of a present job to be executed; and a job parameter election device for electing a candidate for a job parameter set for the present job by retrieving the present page size among the plurality of job parameter sets memorized in the parameter memory.

2. The image processing apparatus of claim 1, wherein the page size acquiring device comprises an original size detector for detecting a size of an original set on an original platen glass, said size of the original being acquired as the present page size of an input image.

3. The image processing apparatus of claim 1, further comprising an execution history registration device for registering, for each job parameter set, an execution history of a job executed by using the each job parameter set, wherein the job parameter election device elects the candidate based on the present page size acquired by the page size acquiring device and on the execution history of a job.

4. The image processing apparatus of claim 3, wherein the execution history registration device counts an execution number of times, and a result of counting is registered as the execution history.

5. The image processing apparatus of claim 3, wherein the execution history registration device registers a job execution date as the execution history.

6. The image processing apparatus of claim 1, further comprising:

a job parameter display for presenting to a user the candidate for a job parameter set elected by the job parameter election device; and an answer receiving device for asking the user whether the candidate for a job parameter set presented by the job parameter display should be adopted or not, wherein the job parameter election device elects a single candidate for the job parameter set, and the job parameter display presents to the user details of set values contained in the single candidate for the job parameter set.

7. The image processing apparatus of claim 1, further comprising:

a list display for showing a list of candidates for a job parameter set, the candidates for a job parameter set being elected by the job parameter election device; and a selection receiving device for receiving a selection by the user of the job parameter set to be employed for the present job to be executed, out of the candidates shown by the list display.

8. The image processing apparatus of claim 7, further comprises a sorting device for arranging the candidates elected by the job parameter election device, according to a prescribed standard, wherein the list display shows the list of the candidates for a job parameter set according to an order arranged by the sorting device.

9. The image processing apparatus of claim 8, wherein the prescribed standard for arranging the candidates is capable to be changed.

10. The image processing apparatus of claim 7, wherein the list display displays any one of the following items for each job parameter set: a job parameter set name assigned to a job parameter set; a total execution number of times for the job executed by using the job parameter set; and a date of previous execution of the job executed by using the job parameter set.

11. The image processing apparatus of claim 1, wherein the job parameter set is administered for each user, and the job parameter election device elects the candidate for a job parameter set from job parameter sets associated with the user going to input the present job.

12. The image processing apparatus of claim 11, wherein authentication of the user going to input the present job is carried out by any one of a key card, key counter, coin vendor, password input device, ID number input device, fingerprint authentication, and voice recognition.

13. The image processing apparatus of claim 1, wherein jobs to be executed by the image processing apparatus are classified into plural types of function modes based on respective functions, and the job parameter set is administered for each of the plural types of function modes, wherein the job parameter election device elects the candidate from the job parameter sets corresponding to the function mode of the present job to be executed.

14. The image processing apparatus of claim 1, further comprising:

a machine default memory for storing a machine default value of the job parameter set; and a normal setting image screen display for displaying a normal setting image screen to be used for changing the set value for each setup item, wherein when a candidate of a job parameter set to be used for a job inputted this time, which is selected by the job parameter election device, is rejected by a user, the normal setting image screen display displays the normal setting image screen, where the machine default value is displayed as the default value of each setup item.

15. The image processing apparatus of claim 1, further comprising:

a parameter determination device for determining whether or not the job can be executed according to the job parameter set to be used for the present job inputted this time; and an alarm device for notifying a decision-of the parameter determination device to a user and prompting the user to change a set value that has caused impossible execution of the job, when the parameter determination device has determined impossible execution of the job.

16. The image processing apparatus of claim 15, wherein when the impossible execution is due to the lack of recording paper of a specified size, the alarm device notifies to that effect, and prompts the user to change the size of recording paper or to supply paper.

17. The image processing apparatus of claim 1, further comprising:

a parameter determination device for determining whether or not the job can be executed according to the job parameter set to be used for the present job inputted this time;

an outputting site changing device for checking whether or not there is any ejection tray capable of correct ejecting, and changing an ejecting destination to an ejection tray capable of correct ejecting if there is any, when the parameter determination device has determined that the job cannot be executed and this impossible execution of the job is due to incapable ejection to the specified ejection tray; and a change notification device for notifying the change of the ejecting destination to the user, when the ejecting destination has been changed by the outputting site changing device.

18. The image processing apparatus of claim 1, further comprising a page size likeness table where a similar page size is associated and registered for each page size, wherein if the job parameter memory does not contain the job parameter set corresponding to the page size acquired by the page size acquiring device, the job parameter election device acquires the page size similar to the page size from the page size likeness table, and elects a candidate for the job parameter set based on this similar page size.

19. The image processing apparatus of claim 1, further comprising:

a parameter determination device for determining whether or not the job can be executed according to the job parameter set to be used for the job inputted this time; and an alternative value estimation device, wherein when the parameter determination device has determined that execution is impossible, the alternative value estimation device elects the job parameter set according to which the job can be executed, said job parameter set having the same set value other than the set value of the setup item having caused impossible-execution as that of the job parameter set having been determined as impossible execution, and the alternative value estimation device picks up the set value of the same setup item as that having caused impossible execution from this job parameter set, and presents it to the user as an alternative value of the setup item.

20. The image processing apparatus of claim 1, wherein if the job parameter set to be used for the present job inputted this time is new, the job parameter set is additionally stored into the job parameter memory.

21. The image processing apparatus of claim 1, further comprises a job parameter delete device for deleting the job parameter set stored in the job parameter memory.

22. The image processing apparatus of claim 1, further comprises a job parameter correction device for editing and correcting the job parameter set stored in the job parameter memory.

23. The image processing apparatus of claim 22, wherein the job parameter delete device has the function of correcting the contents of the job parameter set elected by the job parameter election device based on a user's instruction.

24. The image processing apparatus of claim 1, further comprises a job parameter copy device for forming a copy of the job parameter set stored in the job parameter memory.

25. The image processing apparatus of claim 24, wherein the job parameter copy device is capable of forming a copy of a job parameter set as any one of the machine default value, the job parameter set of another user, and as the job parameter set of the same user as the user of an original job parameter set.

26. The image processing apparatus of claim 24, wherein when the job parameter copy device forms a copy as a job parameter set of the same user as the user of an original job parameter set, the job parameter set name different from the original job parameter set name is assigned to the copy.

27. The image processing apparatus of claim 1, further comprises a destination confirmation device for confirming with a user to determine whether or not the destination denoted by destination information is adopted, when this destination information for specifying the output destination is registered in a form associated with the job parameter set to be used for the present job inputted this time.

28. The image processing apparatus of claim 1, wherein when the setup item of the present job inputted this time incorporates the destination information for specifying an output destination, the default value of the setup item related to this destination information is set in such a way that destination is not yet specified.

29. The image processing apparatus of claim 1, wherein when an operation has been made to confirm the job parameter set to be used for the present job inputted this time, a job execution operation starts without waiting for a separate operation of specifying a start of job execution.

30. The image processing apparatus of claim 1, wherein after the job parameter set to be used for the present job is selected, when the job execution start specifying operation has been made prior to a confirmation operation to confirm the job parameter set, the job execution starts by using the selected job parameter set.

31. The image processing apparatus of claim 1 being configured to be capable of executing at least one of a copy job of optically reading an original and forming the corresponding image on a recording paper, a scan job of optically reading an original and outputting the corresponding image data, a facsimile transmission/reception job, and a print job of forming an image on recording paper according to the print data to be inputted.

32. An image processing system for executing a job by using a job parameter set including a combination of values of various setup items which define an operation condition of the job as a work unit, the image processing system is configured to:

memorize a plurality of job parameter sets, each of the plurality of job parameter sets being associated with a page size of an input image of a job having been executed;

acquire a present page size of an input image of a present job to be executed; and elect a candidate for a job parameter set for the present job by retrieving the present page size among the plurality of job parameter sets memorized.

33. The image processing system of claim 32, further configured to detect a size of an original set on an original platen glass, said size of the original being acquired as the present page size of an input image of the present job.

34. The image processing system of claim 33, further configured to:

register an execution history of a job executed by using each job parameter set, for each of the job parameter set; and elect the candidate base on the present page size acquired and on the execution history of a job.

* * * * *